US011559107B2

(12) United States Patent
Markison et al.

(10) Patent No.: US 11,559,107 B2
(45) **Date of Patent: *Jan. 24, 2023**

(54) ATHLETIC SHOE OUTSOLE WITH GRIP AND GLIDE TREAD PATTERN

(71) Applicant: Athalonz, LLC, Mesa, AZ (US)

(72) Inventors: Timothy W. Markison, Mesa, AZ (US); Jeremiah Johnston, Gilbert, AZ (US); Patricia A. Markison, Phoenix, AZ (US)

(73) Assignee: Athalonz, LLC, Mesa, AZ (US)

( * ) Notice: Subject to any disclaimer, the term of this patent is extended or adjusted under 35 U.S.C. 154(b) by 167 days.

This patent is subject to a terminal disclaimer.

(21) Appl. No.: 17/108,235

(22) Filed: Dec. 1, 2020

(65) Prior Publication Data

US 2021/0076773 A1 Mar. 18, 2021

Related U.S. Application Data

(63) Continuation of application No. 16/112,096, filed on Aug. 24, 2018, now Pat. No. 10,881,168, which is a (Continued)

(51) Int. Cl.

| | |
|---|---|
| ***A43B 5/00*** | (2022.01) |
| ***A43B 13/26*** | (2006.01) |
| ***A43B 23/02*** | (2006.01) |
| ***A43C 15/02*** | (2006.01) |
| ***A43C 13/04*** | (2006.01) |
| ***A43B 13/22*** | (2006.01) |
| *A43C 3/00* | (2006.01) |
| *A43C 11/14* | (2006.01) |
| *A43B 23/26* | (2006.01) |

(Continued)

(52) U.S. Cl.

CPC ..... *A43B 13/26* (2013.01); *A43B 13/223* (2013.01); *A43B 23/027* (2013.01); *A43C 13/04* (2013.01); *A43C 15/02* (2013.01); *A43B 5/00* (2013.01); *A43B 19/00* (2013.01); *A43B 23/0295* (2013.01); *A43B 23/26* (2013.01); *A43C 1/00* (2013.01); *A43C 3/00* (2013.01); *A43C 7/00* (2013.01); *A43C 11/1493* (2013.01); *A43C 15/16* (2013.01); *A43C 15/162* (2013.01)

(58) Field of Classification Search

CPC ..... A43B 5/00; A43C 13/04; A43C 15/16
USPC ..... 36/59 R, 134, 67 R, 67 D, 126, 59 C
See application file for complete search history.

(56) References Cited

U.S. PATENT DOCUMENTS

| | | | |
|---|---|---|---|
| 886,341 | A | 5/1908 | Schmid |
| 1,876,195 | A | 9/1932 | Grant |

(Continued)

*Primary Examiner* — Marie D Bays
(74) *Attorney, Agent, or Firm* — Garlick & Markison; Timothy W. Markison

(57) ABSTRACT

An outsole for an athletic shoe that includes a heel section and a forefoot section. The heel and forefoot sections are on the outer surface of the outsole. The forefoot section includes a tread pattern that provides first and second ground friction forces. The first ground friction force promotes rotation in a first rotational direction about a rotation point of the forefoot section. The second ground friction force restricts rotation in a second rotational direction about the rotation point. The second rotational direction is opposite of the first rotational direction and the second ground friction force is greater than the first ground friction force.

11 Claims, 22 Drawing Sheets

Related U.S. Application Data continuation-in-part of application No. 15/925,550, filed on Mar. 19, 2018, now Pat. No. 10,856,614.

(60) Provisional application No. 62/473,928, filed on Mar. 20, 2017.

(51) Int. Cl.

| | |
|---|---|
| *A43C 1/00* | (2006.01) |
| *A43B 19/00* | (2006.01) |
| *A43C 15/16* | (2006.01) |
| *A43C 7/00* | (2006.01) |

(56) References Cited

U.S. PATENT DOCUMENTS

| | | | | |
|---|---|---|---|---|
| 2,677,905 | A | 5/1954 | Dye | |
| 2,678,507 | A | 5/1954 | Dye | |
| 3,127,687 | A | 4/1964 | Hollister | |
| 3,577,663 | A | 5/1971 | Mershon | |
| 4,347,674 | A | 9/1982 | George | |
| 4,393,604 | A | 7/1983 | Crowley | |
| 4,586,274 | A | 5/1986 | Blair | |
| 4,653,206 | A | 3/1987 | Tanel | |
| 4,667,425 | A | 5/1987 | Effler | |
| 4,670,997 | A | 6/1987 | Beekman | |
| 4,689,901 | A | 9/1987 | Ihlenburg | |
| 4,723,365 | A | 2/1988 | Tanel | |
| D294,655 | S | 3/1988 | Heyes | |
| D295,231 | S | 4/1988 | Heyes | |
| 4,748,752 | A | 6/1988 | Tanel | |
| 5,943,794 | A | 8/1999 | Gelsomini | |
| 6,101,746 | A | 8/2000 | Evans | |
| 6,705,027 | B1 | 3/2004 | Campbell | |
| 7,762,009 | B2 | 7/2010 | Gerber | |
| 8,578,630 | B2 | 11/2013 | Diepenbrock | |
| 8,966,787 | B2 | 3/2015 | Auger | |
| 8,984,774 | B2 | 3/2015 | Minami | |
| 10,881,168 | B2 * | 1/2021 | Markison | A43B 23/0235 |
| 2008/0098624 | A1 | 5/2008 | Goldman | |
| 2011/0197478 | A1 | 8/2011 | Baker | |
| 2013/0067771 | A1 | 3/2013 | Minami | |
| 2013/0067777 | A1 | 3/2013 | Minami | |
| 2015/0096199 | A1 | 4/2015 | Cavaliere | |

* cited by examiner top view medial side view rear view lateral side view top view

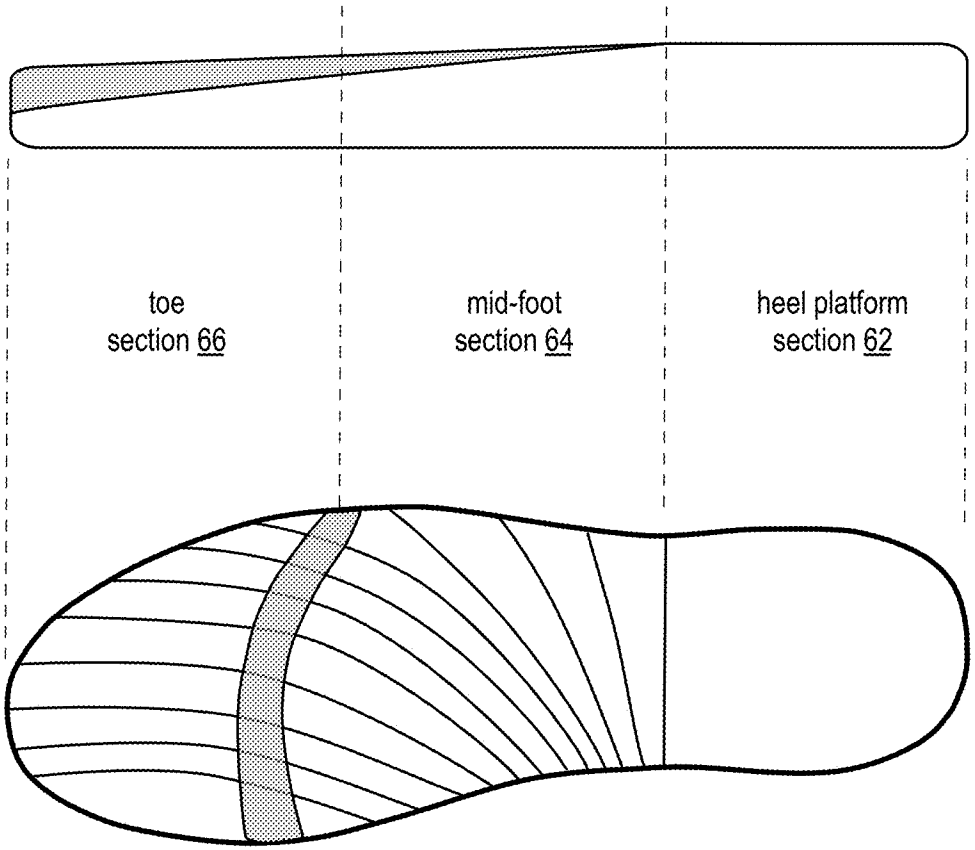
FIG. 1H
top view
midsole 12
FIG. 1G
medial view
midsole 12
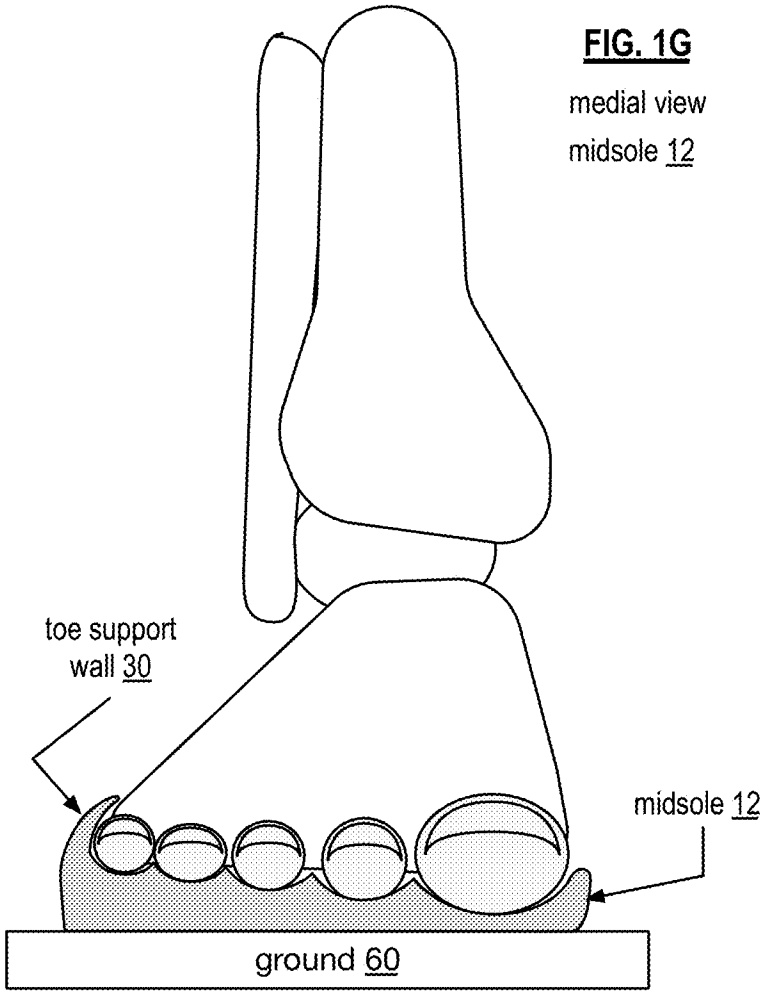
FIG. 1F
front view

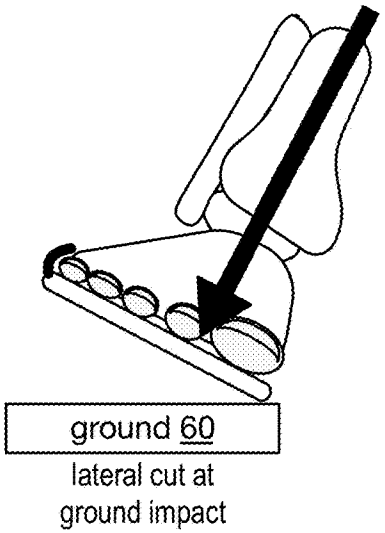
FIG. 1M
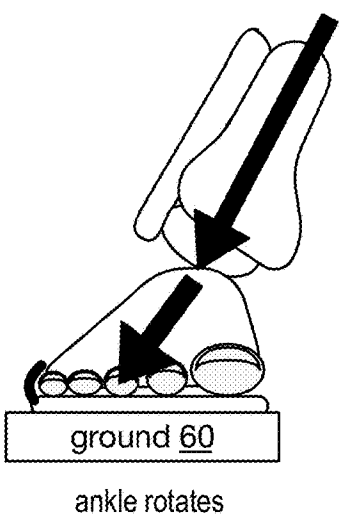
FIG. 1N
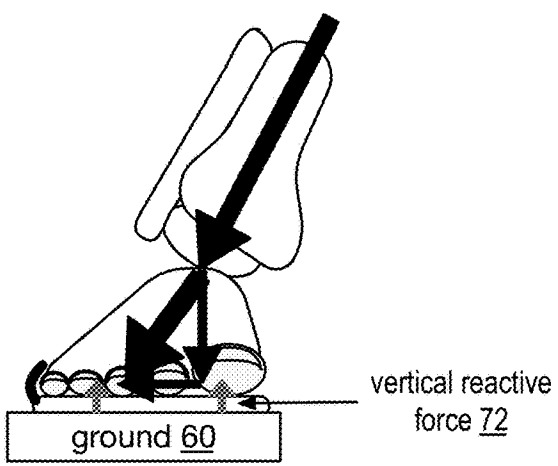
FIG. 1O
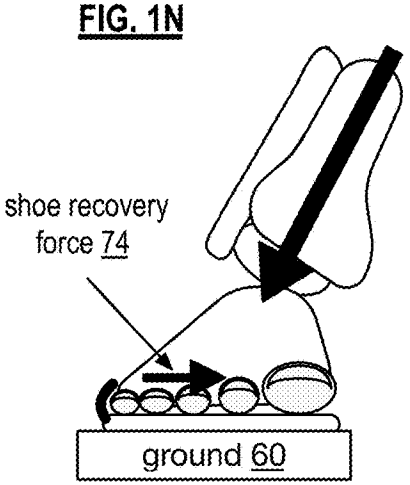
FIG. 1P
FIG. 1Q
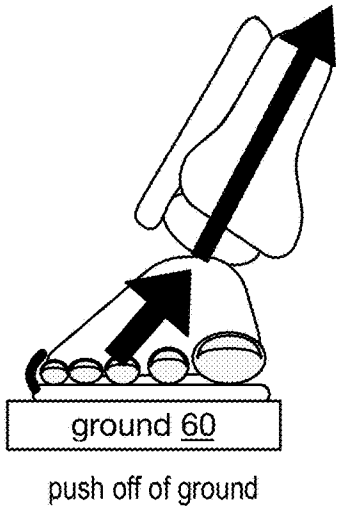
FIG. 1R top view medial side view rear view lateral side view lateral side view with vamp and quarter sections removed top view top view top view top view medial side view rear view lateral side view top view medial side view top view medial side view bottom view bottom view
inside of left shoe bottom view bottom view bottom view right foot top view medial side view

ATHLETIC SHOE OUTSOLE WITH GRIP AND GLIDE TREAD PATTERN

CROSS REFERENCE TO RELATED APPLICATIONS

The present U.S. Utility Patent Application claims priority pursuant to 35 U.S.C. § 120 as a continuation of U.S. Utility application Ser. No. 16/112,096, filed Aug. 24, 2018, entitled "ATHLETIC SHOE OUTSOLE WITH GRIP AND GLIDE TREAD PATTERN", which is a continuation-in-part of U.S. Utility application Ser. No. 15/925,550, entitled "ATHLETIC SHOE WITH PERFORMANCE FEATURES", filed Mar. 19, 2018, issuing on Dec. 8, 2020 as U.S. Pat. No. 10,856,614, which claims priority pursuant to 35 U.S.C. § 119(e) to U.S. Provisional Application No. 62/473,928, entitled "ATHLETIC SHOE", filed Mar. 20, 2017, all of which are hereby incorporated herein by reference in their entirety and made part of the present U.S. Utility Patent Application for all purposes.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISC

Not applicable.

BACKGROUND OF THE INVENTION

Technical Field of the Invention

This invention relates generally to footwear and more particularly to traction patterns for athletic footwear.

Description of Related Art

As is known, a wide variety of shoes are available in today's market. The types, designs, and style of the shoes vary greatly depending on their use. For example, dress shoes have a particular design and style based on a more formal use. As another example, athletic shoes have a particular design and style based on their use while playing sports. For instance, each of tennis shoes, golf shoes, running shoes, cross training shoes, hiking shoes, basketball shoes, etcetera have a particular sole pattern, a sole design, an insole design, and upper shoe portion design. In addition, each type of shoe may further include, for a variety of health reasons, an arch support design, a pronation compensation design, and/or a supination compensation design.

BRIEF DESCRIPTION OF THE SEVERAL VIEWS OF THE DRAWING(S)

FIG. 1F is a front view diagram of an example of an optimal athletic positioning (OAP) midsole of an athletic shoe in accordance with the present invention;

FIG. 1G is a medial view diagram of an example of an optimal athletic positioning (OAP) midsole of an athletic shoe in accordance with the present invention;

FIG. 1H is a top view diagram of an example of an optimal athletic positioning (OAP) midsole of an athletic shoe in accordance with the present invention;

FIGS. 1M-1R are a front view example of shoe reactive forces of an athletic shoe with a conventional flat midsole in accordance with the present invention;

DETAILED DESCRIPTION OF THE INVENTION

Figures 1A, 1B:
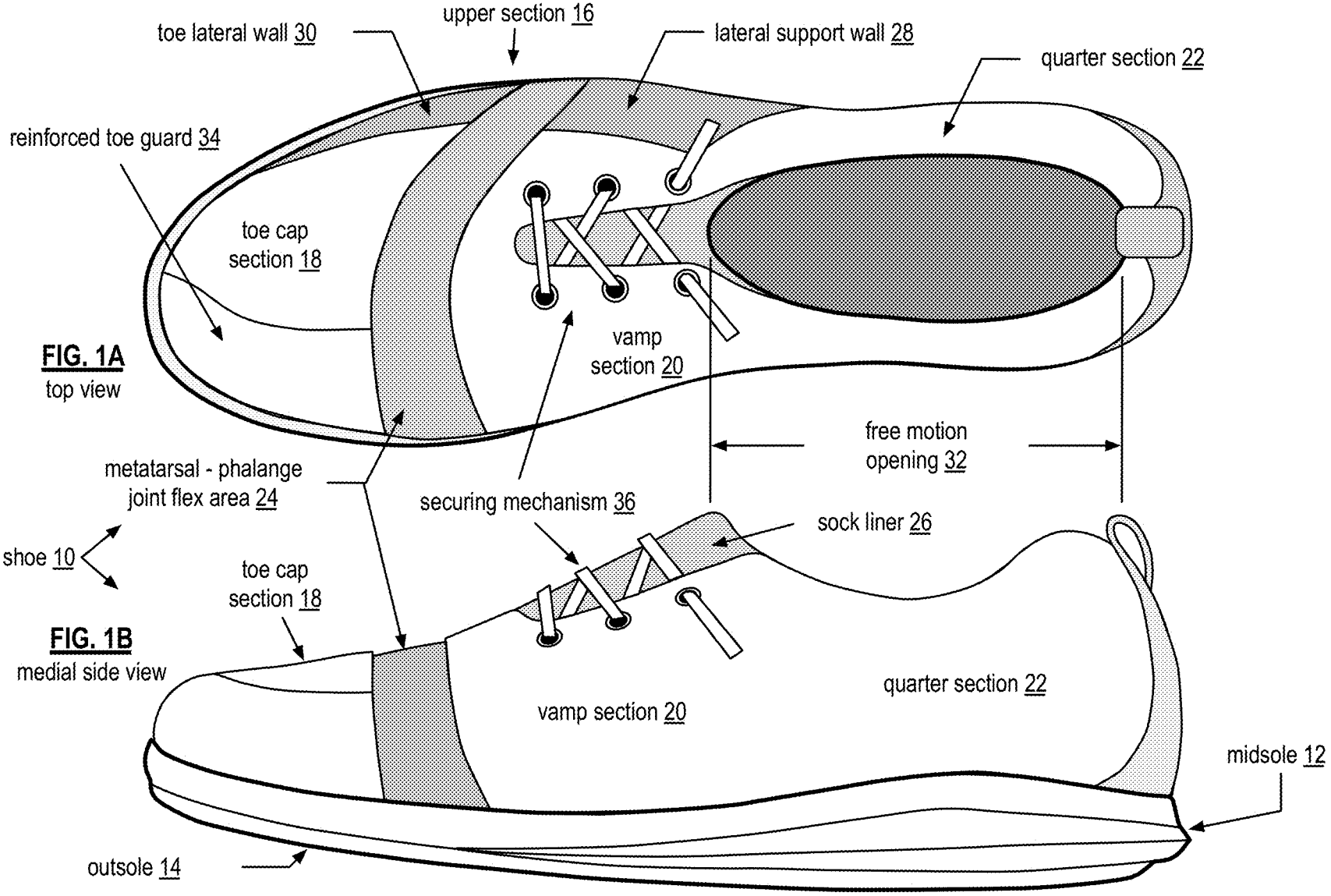
FIG. 1A is a top view diagram of an embodiment of an athletic shoe in accordance with the present invention.
FIG. 1B is a medial view diagram of an embodiment of an athletic shoe in accordance with the present invention.

FIGS. 1A and 1B are a top view diagram and a side view diagram, respectively, of an embodiment of an athletic shoe 10 that includes a midsole 12, an outsole 14, and an upper section 16. The upper section 16 includes a toe cap section 18, a vamp section 20, a quarter section 22, a metatarsal-phalange joint flex area 24, a sock liner 26, and a securing mechanism 36. The upper section 16 may further include a toe lateral wall 30, a lateral support wall 28, and/or a reinforced toe guard 34.

The toe cap section 18 covers the toe area of the shoe 10 and may further include the reinforced toe guard 34. The toe cap section 18 is constructed of a first material that includes one or more of a leather, a molded plastic, a molded carbon fiber, a polyurethane (PU), a thermoplastic polyurethane (TPU), a faux leather, a PU leather, a fabric, steel, aluminum, etc. The reinforced toe guard is optional and, when included, is constructed of one or more materials that include, but are not limited to, a PU, a laminate, a molded TPU, a molded carbon fiber, and a molded plastic. The reinforced toe guard is attached to the toe cap section via lamination, stitching, gluing, painting, embedded, integrated, etc. In addition, the reinforced toe guard is attached to the midsole 12 and/or outsole 14.

The vamp section 20 covers at least a portion of a midfoot area of the shoe (e.g., from the ball of the foot to middle of the arch). The vamp section 20 is constructed of the same material as the toe cap or a different material (e.g., a PU, a TPU, a leather, a faux leather, etc.). For example, each of the toe section 18 and the vamp section 20 is constructed from polyurethane, a leather, or a combination thereof. As another example, the toe section 18 is constructed of a molded plastic to provide a "steel-toed shoe" and the vamp section 20 is constructed from polyurethane, a leather, or a combination thereof.

The quarter section 22 provides a rear portion of the upper section. For example, the quarter section 22 provides the heel wall and sides around the shoe opening. The quarter section 22 may be reinforced to maintain structural integrity of the shoe over time. The quarter section 22 is constructed of the same material as the toe cap section 18, as the vamp section 20, or of a different material (e.g., a PU, a TPU, a leather, a faux leather, etc.). In an embodiment, the quarter section 22 is constructed of a different material than the vamp section 20. In this instance, the quarter section 22 is attached to the vamp section 20 via one or more of lamination, stitching, gluing, riveting, lacing, etc.

In another embodiment, the quarter section 22 and the vamp section 20 are constructed of the same material(s). In this instance, a continuous material(s) is used to implement the quarter section 22 and the vamp section 24. As such, the continuous material provides the coupling between the quarter section 22 and the vamp section 20.

The metatarsal-phalange joint flex area 24 couples to the toe cap section 18 and to the vamp section 20 via one or more of lamination, stitching, gluing, riveting, lacing, etc. The metatarsal-phalange joint flex area 24 is positioned within the upper section 16 to cover the metatarsal-phalange joints of a foot when placed in the shoe 10. In addition, the metatarsal-phalange joint flex area 24 is constructed of a different material than that of the toe section 18, the vamp section 20, and the quarter section 22. For example, the material of flex area 24 includes one or more of a cloth, a fabric, a mesh, a lightweight PU, a polyester, and a synthetic fabric. As another example, the material of the flex area 24 includes a water-resistant material and/or a water-resistant treatment on a non-water proof material.

The material of the metatarsal-phalange joint flex area 24 is of a softer and/or more flexible material than is used in the other parts of the upper. For instance, Young's modulus measures the resistance of a material to elastic (recoverable) deformation under load. A stiff material has a high Young's modulus, changes its shape only slightly under elastic loads, and returns to its original shape when the load is removed. A flexible material has a low Young's modulus, changes its shape considerably under load, and returns to its original shape when the load is removed. Note that specific stiffness is Young's modulus divided by density and that Young's modulus is equal to elastic stress/strain. Further note that strain has no units; thus, units for Young's modulus are the same as for stress: N/m2, or Pascal.

With reference to Young's modulus, material of the metatarsal-phalange joint flex area 24 is of a lower value than that of the materials of the toe cap section 18, the vamp section 20, and the quarter section 22. For example, the Young's modulus value for the material of the metatarsal-phalange joint flex area 24 is no more than 75% of the Young's modulus value for the materials the toe cap section 18, the vamp section 20, and the quarter section 22. With the material of metatarsal-phalange joint flex area 24 being softer and/or more flexible material than the materials used in the other parts of the upper, the pinching and binding on the top of the metatarsals and the phalanges that result from being the toes is substantially eliminated. Thereby providing more comfort and more freedom of movement.

When included, the sock liner 26 is constructed of one or more materials that include, but is not limited to, neoprene, airoprene, spandex, etc. The sock liner 26 is positioned within, and coupled to, at least a portion of the quarter section 22 and at least a portion of the vamp section 20. For example, the sock liner 26 spans from the metatarsal-phalange joint flex area 24 through the vamp and quarter sections 20 and 22 and provides the tongue of the shoe. In another example, the sock liner 26 covers, from within the shoe, the securing mechanism 36 and an upper portion of the quarter section 22. Regardless of the particular embodiment of the sock liner 26, it is coupled to the vamp section 20 and/or the quarter section 22 in one or more places via one or more of lamination, stitching, gluing, riveting, lacing, etc.

As an example, the vamp section 20 and/or the quarter section 22 are attached at the periphery of the sock liner 26.

In this manner, the vamp section 20 and/or the quarter section 22 are free to move over the sock liner as the laces are tightened. As another example, the vamp section 20 and/or the quarter section 22 are attached at the periphery of the sock liner 26 and along the lip of the sock liner that forms the free motion opening 32.

The securing mechanism 36 functions to tighten the shoe 10 around a foot when a foot is placed in the shoe 10. The securing mechanism 36 may be implemented in a variety of ways and positioned within the vamp section 20 is a variety of locations. For example, the securing mechanism 36 includes eyelets and a shoelace that is positioned approximately along a center line of the vamp section 20. With respect to FIG. 1A, the center line is approximately along a midline between a medial edge of the shoe and a lateral edge of the shoe running the length of the vamp section 20.

Figure 6A:
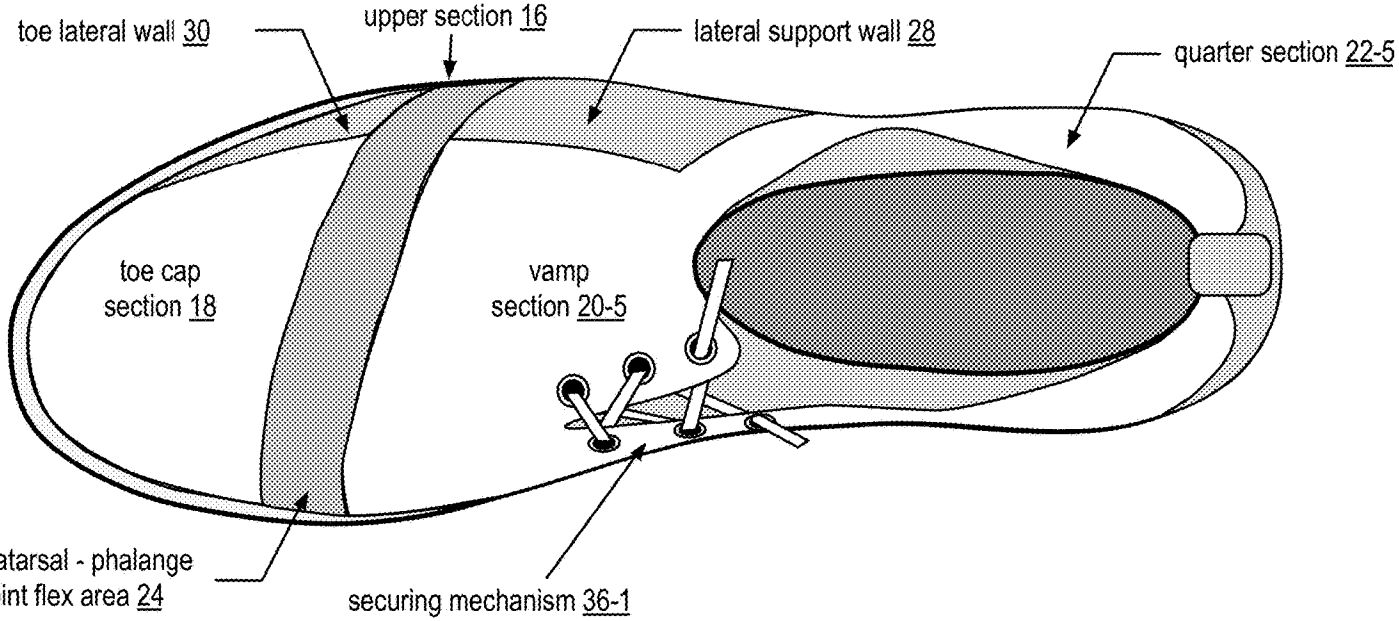
FIG. 6A is a top view diagram of an embodiment of an athletic shoe in accordance with the present invention.
Figure 6B:
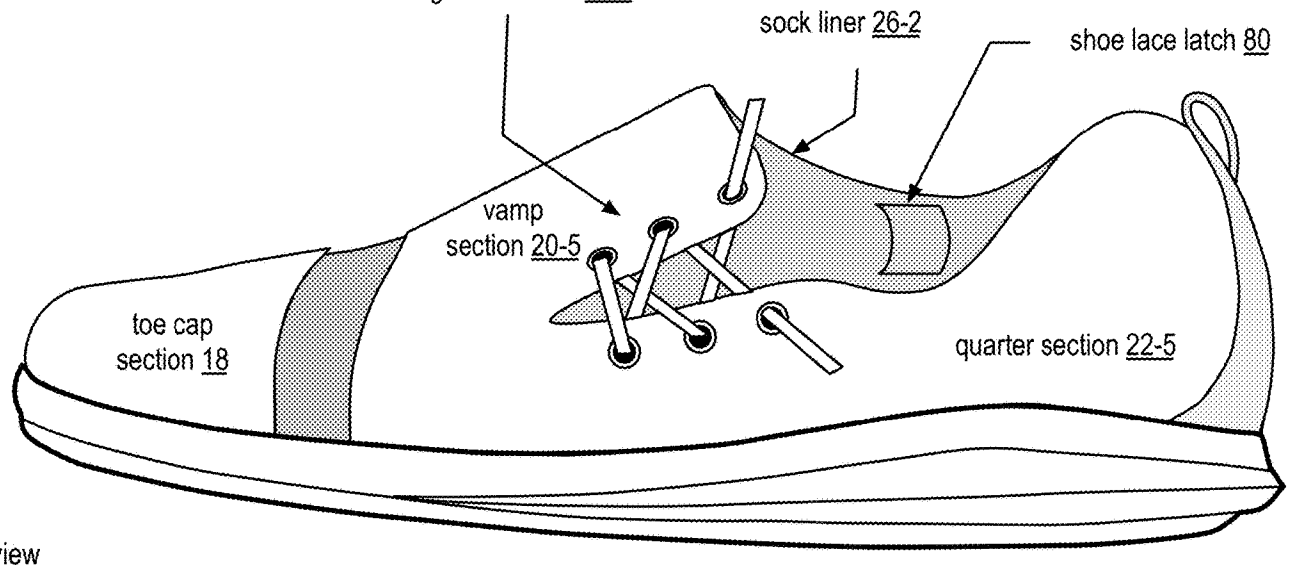
FIG. 6B is a medial view diagram of an embodiment of an athletic shoe in accordance with the present invention.
Figures 6C, 6D:
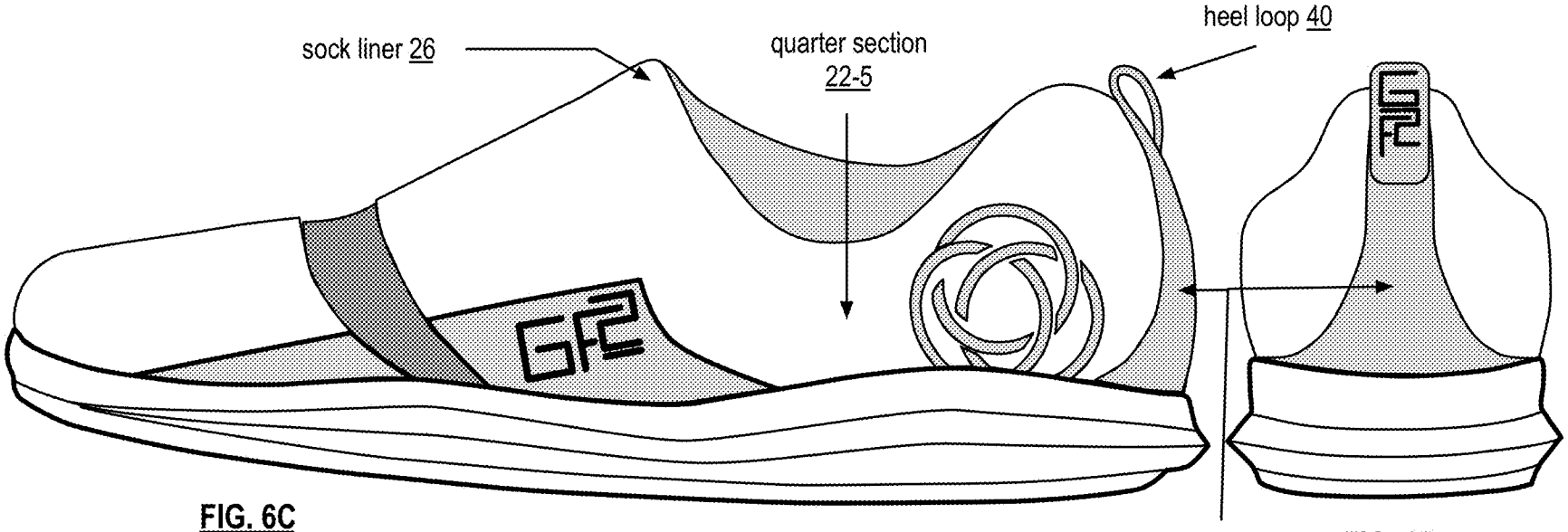
FIG. 6C is a lateral view diagram of an embodiment of an athletic shoe in accordance with the present invention.
FIG. 6D is a rear-view diagram of an embodiment of an athletic shoe in accordance with the present invention.

In another example, the securing mechanism 36 includes eyelets and a shoelace that is positioned approximately along a line that is between a midline of the shoe and a medial edge of the shoe. For instance, the midline is approximately centered between the medial edge of the shoe and a lateral edge of the shoe. An embodiment of this example is discussed with reference to one or more of FIGS. 6A and 6B. Other embodiments of the securing mechanism are discussed with reference to FIGS. 7A, 7B, 8A, and/or 8B.

The midsole 12 is constructed of one or more materials that include, but is not limited to, Ethylene-vinyl acetate (EVA), poly (ethylene-vinyl acetate) (PEVA), rubber, carbon fiber, cork, etc. An embodiment of the midsole 12 is discussed in greater detail with reference to FIGS. 1G-1H.

The outsole 14 is constructed of one or more materials that include, but is not limited to, rubber, EVA, PEVA, TPU, carbon fiber, plastic, etc. For an athletic shoe, the outsole 14 will have a tread pattern for a particular sport. For example, the tread pattern for a baseball shoe includes plastic and/or metal cleats arranged to provide traction for running, throwing, hitting, and/or fielding in grass, in dirt, and/or on artificial surface. As another example, a training shoe will have a tread pattern for weight lifting, cardio activities, etc. that occur on a gym floor (e.g., wood, concrete, carpet, etc.). An example of a golf shoe tread pattern is discussed with reference to FIGS. 9A, 9B, 9C, 10, 11, and 12A-12C.

Each of the toe lateral wall 30 and the lateral support wall 28 is constructed of one or more materials that include, but is not limited to, PU, TPU, molded carbon fiber, molded plastic, leather, and rubber. The toe lateral wall 30 is attached (e.g., stitched, glued, laminated, etc.) to the upper toe section and to the midsole. The lateral support wall 28 is attached to the upper mid-foot and heel section and to the midsole. The lateral walls 28 and 30 provide a horizontal reactive force when a force is exerted by the foot on the lateral edge of the shoe 10.

The sock liner 24, the vamp section 20, and the quarter section 22 form the free motion opening 32. The size of the free motion opening 32 is proportional to the foot size to allow free motion of the foot and ankle. For example, the free motion opening insures that no material of the shoe is over the muscles, tendons and/or ligaments that restrict flexion of the foot. In one embodiment, the free motion opening is between 33% and 45% of the length of the shoe (e.g., length from heel to toe).

The quarter section 20 may further include a collar that delineates an opening 32 for the shoe 10. The collar (shown as the upper edge of the opening 32) has a geometric shape that minimizes restriction of movement of at least one of a foot and an ankle by substantially eliminated restrictive pressure points of the upper section on the at least one of the foot and the ankle.

The free motion opening 32, the metatarsal-phalange joint flex area 24, the lateral walls 28 and 30, and the midsole 12 function in combination to support optimal athletic positioning throughout an athletic movement with minimal impediments and with minimal energy loss as a result of the shoe. Optimal athletic positioning enables an athlete to maximize his or her ground reaction force, power generation, and to improve efficiency of the kinetic chain.

Figures 1C, 1D:
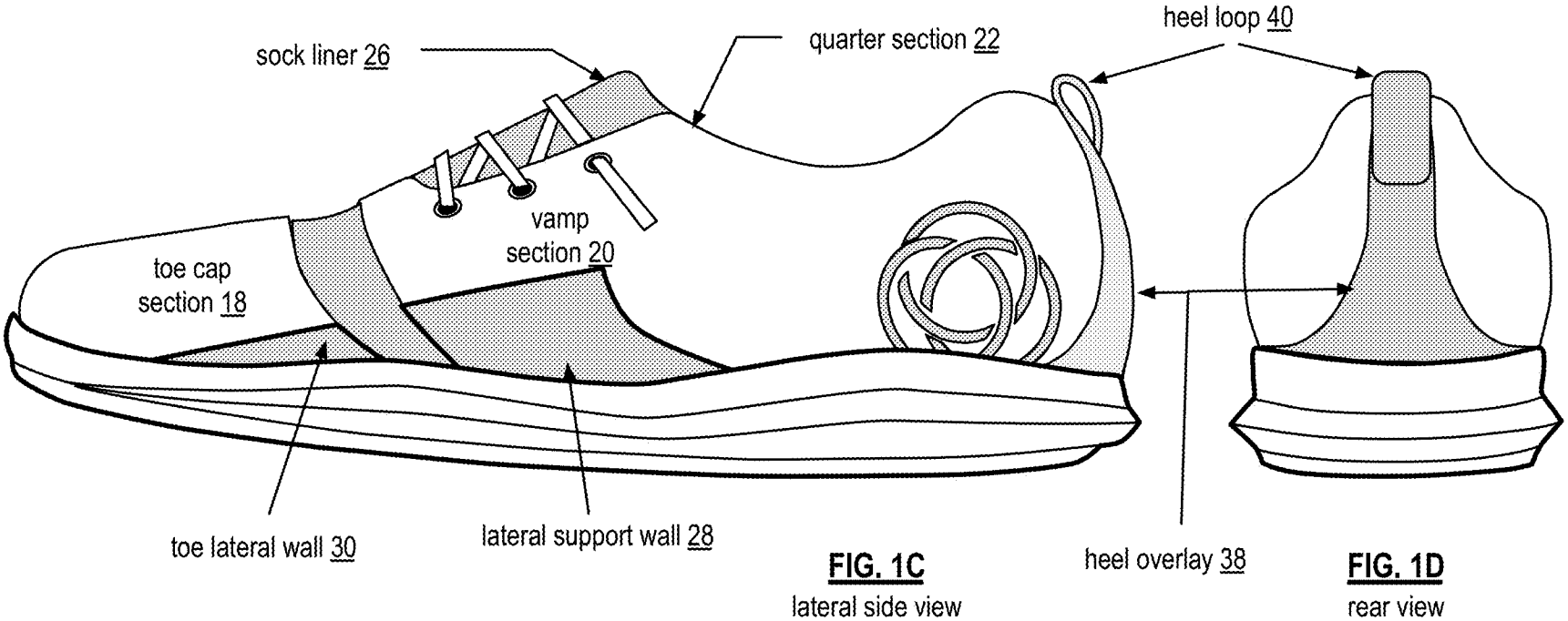
FIG. 1C is a lateral view diagram of an embodiment of an athletic shoe in accordance with the present invention.
FIG. 1D is a rear-view diagram of an embodiment of an athletic shoe in accordance with the present invention.

FIG. 1C is a lateral view diagram of an embodiment of an athletic shoe 10. The toe lateral wall 30 and the lateral support wall 28 function to provide a horizontal reaction force against the foot when an athlete's foot is exerting an angular force with respect to the ground. This will be discussed in greater detail with reference to FIGS. 1I through 1R. Note that a shoe may include only the lateral support wall 28 to provide the horizontal reaction force.

FIG. 1D is a rear-view diagram of an embodiment of an athletic shoe 10 that includes a heel overlay 38 and a heel loop 40. Each of the heel overlay and the heel loop is constructed of one or more materials that include, but is not limited to, leather, a faux leather, a PU, and a fabric. In one embodiment, the heel loop and heel overlay are a single piece of material where the heel loop is formed by stitching a tail of the material back on itself. In another embodiment, the heel loop and the heel overlay are separate pieces and the heel loop is attached to the heel overlay, which is attached to the upper mid-foot and heel section.

Figure 1E:
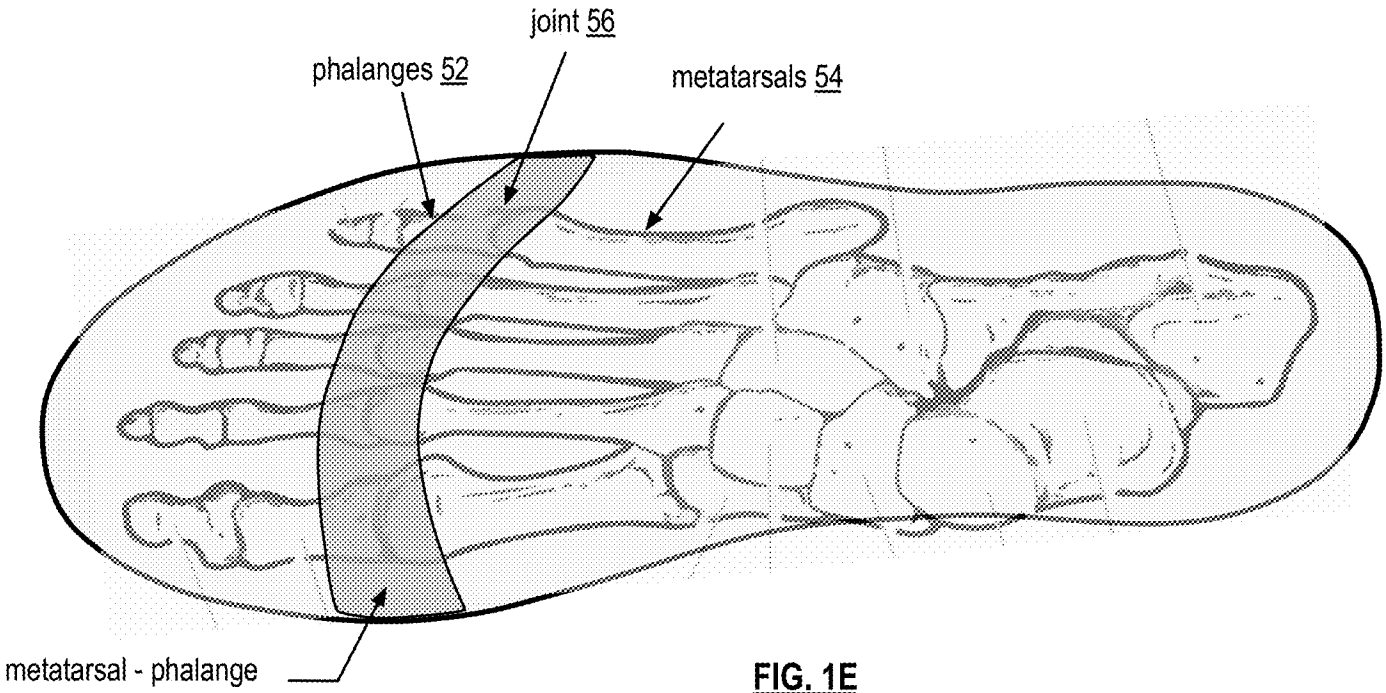
FIG. 1E is a top view diagram of an example of a metatarsal- phalange joint flex area of an athletic shoe in accordance with the present invention.

FIG. 1E is a top view diagram of an example of a metatarsal- phalange joint section 50 of an athletic shoe 10 as it relates to the bones of the foot. The metatarsal-phalange joint section 50, which corresponds to the positioning of the metatarsal-phalange joint flex area 28, is positioned to overlay the joints between the metatarsal bones and the phalange bones. The width of the metatarsal-phalange joint flex area 28 is in the range of ¼ inch to an inch or more. The width may be a fixed width from medial to lateral or a varying width from medial to lateral. For example, the width is 1.25 inches on the medial side and 0.5 inches on the lateral side. The tapering of the width may be linear or non-linear.

With the metatarsal-phalange joint flex area positioned over the metatarsal- phalange joints, the lightweight and flexible material of the metatarsal- phalange joint provides negligible interference when the toes are bent in the shoe (e.g., when walking, running, or other physical activity). In addition to providing freer motion, the metatarsal- phalange joint flex area improves comfort of the shoe by minimizing pressure points on the top of the foot when the toes bend in comparison to conventional athletic shoes.

Figures IF-1H are, a front view diagram, medial view diagram, and top view diagram, respectively of an example of an optimal athletic positioning (OAP) midsole 12 of an athletic shoe. The midsole 12 includes a heel platform section 62, a mid-foot section 64, and a toe section 66. The heel platform section 62 has a width and a length. The width is from an inner edge of the midsole to an outer edge of the midsole. The length is from a rear edge of the midsole to an intersection line between the heel platform section 62 and the mid-foot section 64. The heel platform section 62 has substantially zero slope from the inner edge of the midsole to the outer edge of the midsole.

The mid-foot section 64 is juxtaposed to the heel platform section 62 along the intersection line. The mid-foot section and the toe section collectively have a geometric shape that has a first slope along an inner edge of the midsole from a front edge of the midsole to the intersection line. The geometric shape further includes a second slope from the inner edge of the midsole to an outer edge of the midsole. The geometric shape further includes a third slope along the outer edge of the midsole from the front edge of the midsole to the intersection line. The first slope is greater than the third slope. The second slope has a variable angle from the front edge of the midsole to the intersection line that is based on a difference between the first slope and the third slope. When the shoe is worn, the first, second, and third slopes cause imbalanced weight bearing forces with more of the weight bearing forces being at a ball-of-foot and big toe area than in other areas of the toe and mid-foot sections.

In another embodiment, the OAP midsole 12 includes an angular gradient section and a heel section. The heel section has a zero slope from lateral to medial side with respect to the ground. In an embodiment, the heel section has a slope from heel to mid-foot of up to ¼ inch per inch with respect to the ground. In another embodiment, the heel section has no slope from heel to mid-foot with respect to the ground.

The angular gradient section has a lateral to medial downward slope that positions the big toe at a lower point than most or all of the other toes. In an embodiment, the angular gradient section has a downward slope from the lateral edge to the medial edge at a line corresponding to the metatarsal-phalange joints.

The combination of the heel section and the angular gradient section provide a dynamic athletic positioning adjustment for an athlete. In particular, when an athlete wears the athletic shoe and takes an athletic stance, the weight bearing forces of his or her legs are shifted inward and the inner balls of the feet firmly engage the ground via the shoes. In this position, the athlete is optimally positioned to maximize ground reaction force and efficiently use his or her kinetic chain.

Figure 1I:
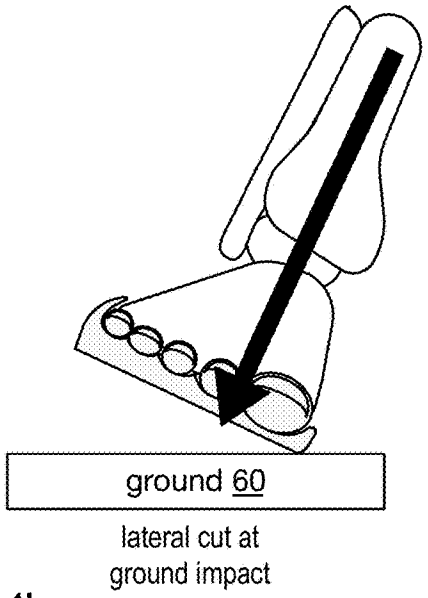
FIGS. 1I-1L are a front view example of shoe reactive forces of an athletic shoe with an OAP midsole and supporting lateral edge in accordance with the present invention.

FIGS. 1I-1L are a front view example of shoe reactive forces of an athletic shoe with an OAP midsole and supporting lateral wall 28 and/or 30. In this example, an athlete is making a lateral movement with his or her leg at a 25-degree angle with respect to the ground 60. The large arrow represents the weight force vector of the athlete. FIG. 1I shows the medial edge of the shoe just touching the ground 60.

Figure 1J:
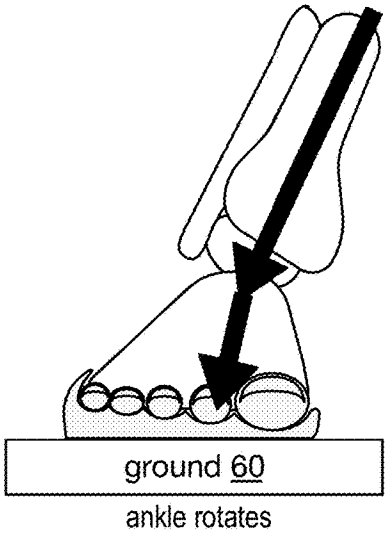

Fractions of a second later, the full or near full outsole is in contact with the ground and the ankle has rotated with respect to FIG. 1I. Note that only the forefoot section of the outsole may be touching the ground when the athlete is making the lateral cut. In this position, as shown in FIG. 1J, the weight force vector is broken into two components: one along the shin and the second from the ankle to the ground.

Figure 1K:
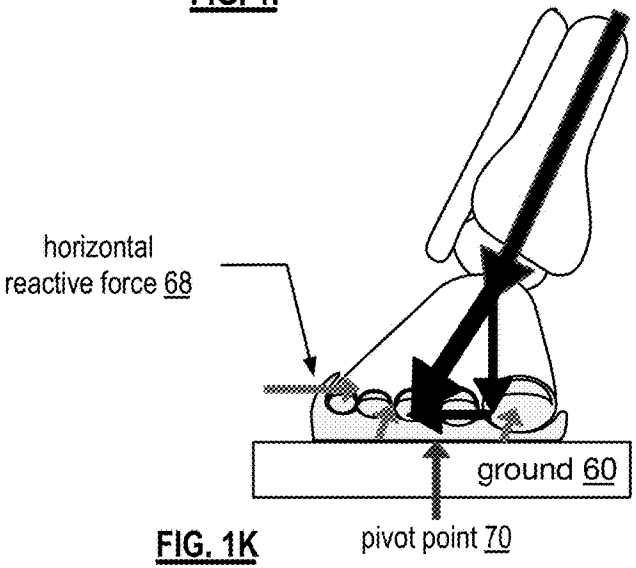
Figure 1L:
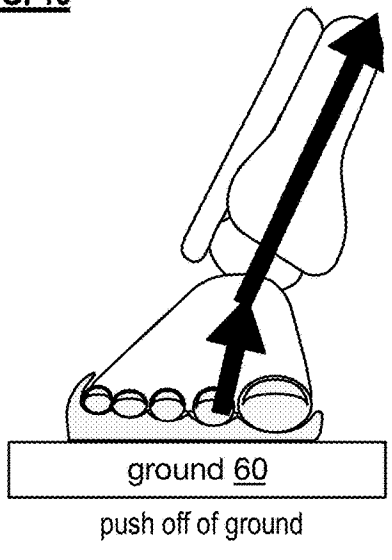

In FIG. 1K, the weight force vector from the ankle to the ground is divided into a vertical force component and a horizontal force component. Note that the weight force vector also includes a component from the shin force component. The shoe creates a shoe reaction force in response to the weight force vector components. The shoe creates a vertical reaction force in response to, and substantially equal to, the vertical component of the weight force. The shoe also creates a horizontal reaction force 68 in response to, and substantially equal to, the horizontal component of the weight force due to the combination of the lateral walls, or edges, (toe and mid-foot) and the OAP midsole. As such, the foot stays "locked-in" to the shoe, keeps a pivot point 70 near mid foot, and allows the athlete to quickly push off (as shown in FIG. 1L) with minimal energy is lost attributable to the shoe.

FIGS. 1M-1R are a front view example of shoe reactive forces of an athletic shoe with a conventional flat midsole and with a conventional upper section. In this example, as in the previous example, an athlete is making a lateral movement with his or her leg at a 25-degree angle with respect to the ground 60. The large arrow represents the weight force vector of the athlete. FIG. 1M shows the medial edge of the shoe just touching the ground.

Fractions of a second later, the full or near full outsole is in contact with the ground and the ankle has rotated with respect to FIG. 1N. Note that only the forefoot section of the outsole may be touching the ground when the athlete is making the lateral cut. In this position, the weight force vector is broken into two components: one along the shin and the second from the ankle to the ground.

In FIG. 1O, the weight force vector from the ankle to the ground 60 is divided into a vertical force component and a horizontal force component. Note that the weight force vector also includes a component from the shin force component. The shoe produces a reaction force 72 that is normal to the ground and is substantially equal to the vertical component of the weight force. The shoe, however, produces minimal horizontal reaction force that is provided the by upper of the shoe.

With minimal horizontal reaction force, the horizontal component of the weight force vector causes the foot to push out on the upper as shown in FIG. 1P. The foot slides in the shoe such that the little toe is beyond or at the lateral edge of the midsole. In addition, this shifts the pivot point 70 to the lateral edge causing the medial edge to lift off of the ground. It takes fractions of a second more for the pivot point to move back to approximately the middle of the shoe as shown in FIG. 1Q and allowing the athlete to push off as shown in FIG. 1R. For every lateral movement made by an athlete, the above sequence occurs and robs the athlete of energy.

FIGS. 2A-2D are a medial, top, lateral, and rear view diagrams, respectively, of another embodiment of an athletic shoe 10-1. This shoe is similar to the one of FIGS. 1A and 1B, in that it includes a toe cap section 18, a vamp section, a quarter section, a sport specific outsole 14, an optimal athletic positioning (OAP) midsole 12, and a free-motion opening. The shoe also includes the heel overlay 38 and the heel loop 40.

In this embodiment, the vamp section 20-1 and the quarter section 22-1 are cut lower around the ankle on the lateral and medial sides than in the embodiment of FIG. 1. This exposes the sock liner 26 more than in the embodiment of FIGS. 1A and 1B and allows for greater freedom of movement of the ankles and foot. While the sock liner 26 is exposed more, the structural integrity of the shoe 10 remains to provide maximize ground reaction force, improve power generation, and efficiently use his or her kinetic chain with minimal energy loss as result of the shoe.

Figures 2A, 2B:
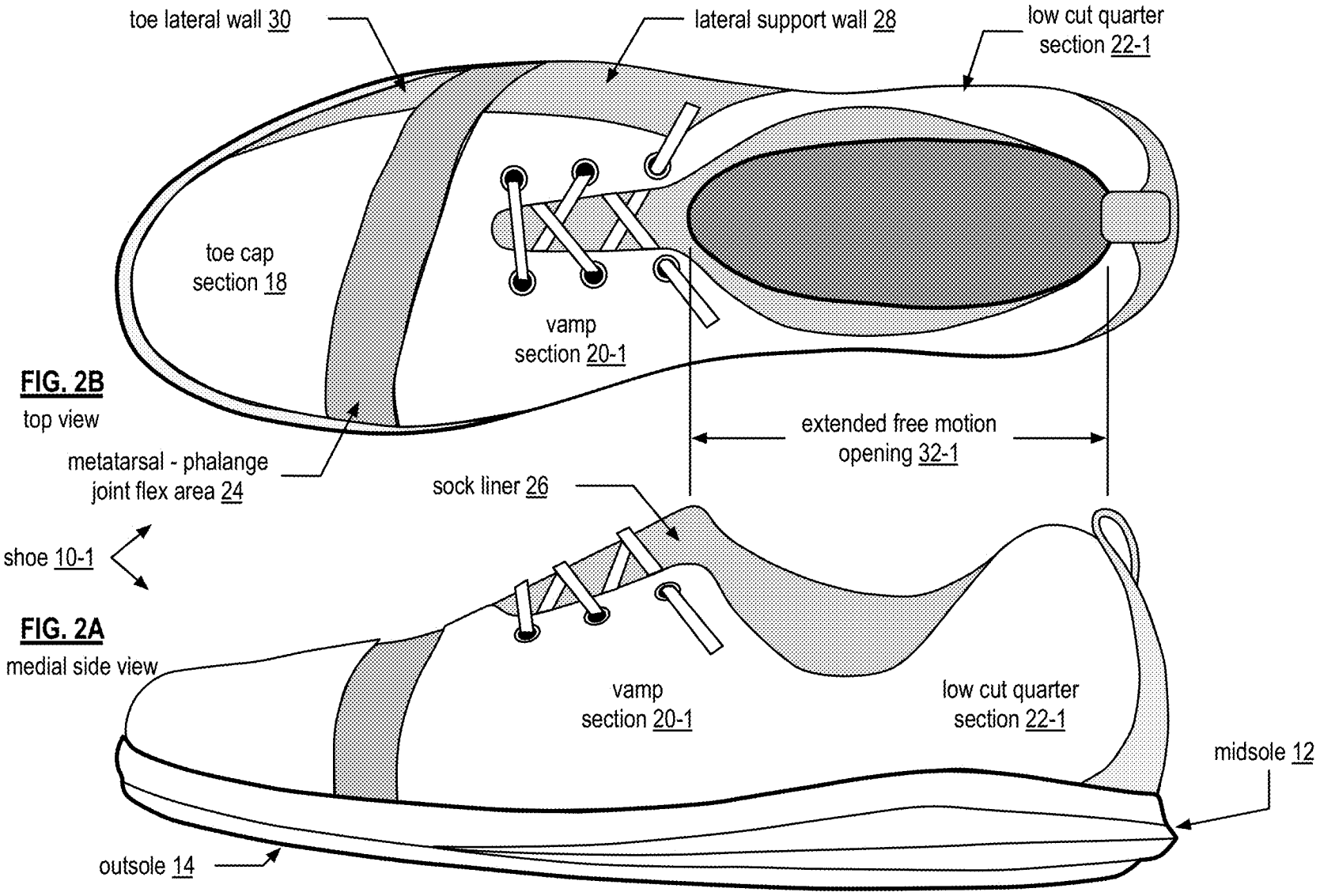
FIG. 2A is a medial view diagram of another embodiment of an athletic shoe in accordance with the present invention.
FIG. 2B is a top view diagram of another embodiment of an athletic shoe in accordance with the present invention.
Figures 2C, 2D:
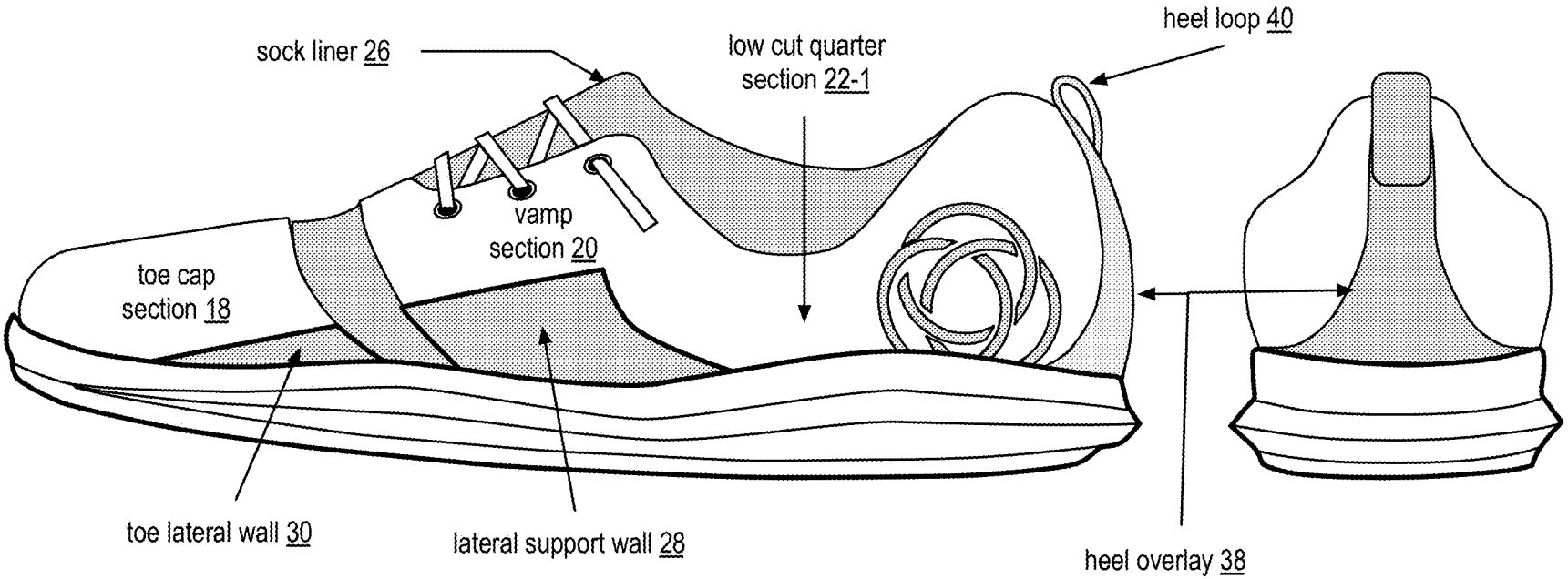
FIG. 2C is a lateral view diagram of another embodiment of an athletic shoe in accordance with the present invention.
FIG. 2D is a rear view diagram of another embodiment of an athletic shoe in accordance with the present invention.
Figure 2E:
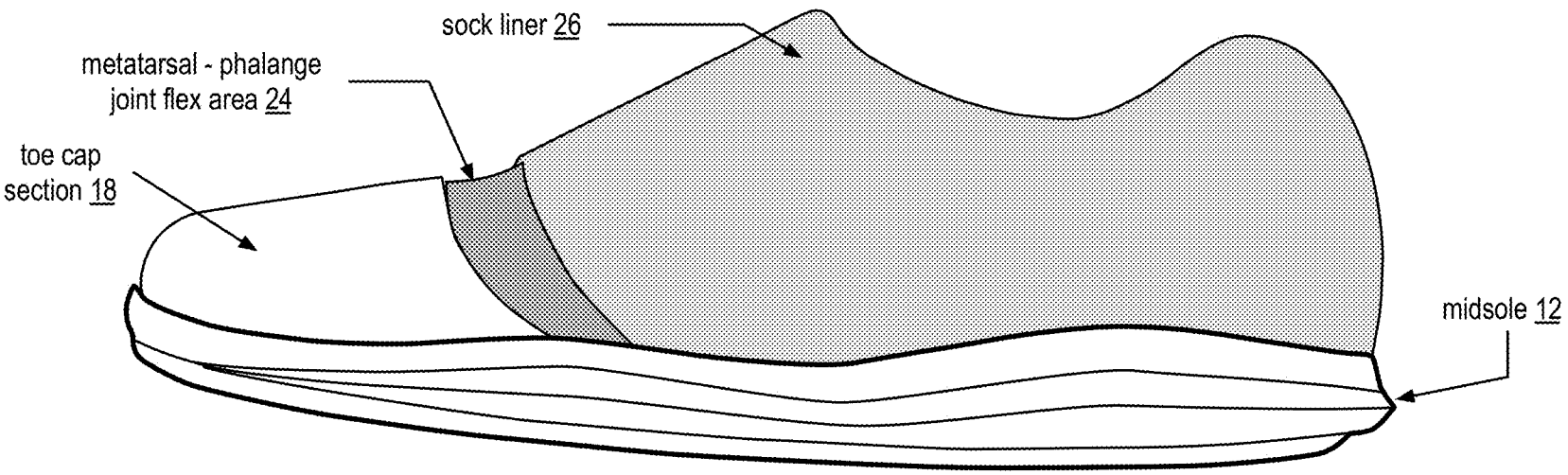
FIG. 2E is a lateral view diagram of another embodiment of an athletic shoe with an upper section removed in accordance with the present invention.

FIG. 2E is a lateral view diagram of another embodiment of an athletic shoe 10 to include the toe cap section 18 and the midsole 12. In this illustration, the vamp and quarter sections removed to expose the sock liner 26. In this embodiment, the sock liner 26 encompasses the foot up to the metatarsal-phalange joint flex area 24. The sock liner 26 provides a flexible and lightweight inner liner on which the upper mid-foot and heel section lies. As such, when the upper mid-foot and heel section is tightened via the laces, the sock liner provides comfort by minimizing pressure points that are induced by the laces.

Figure 3:
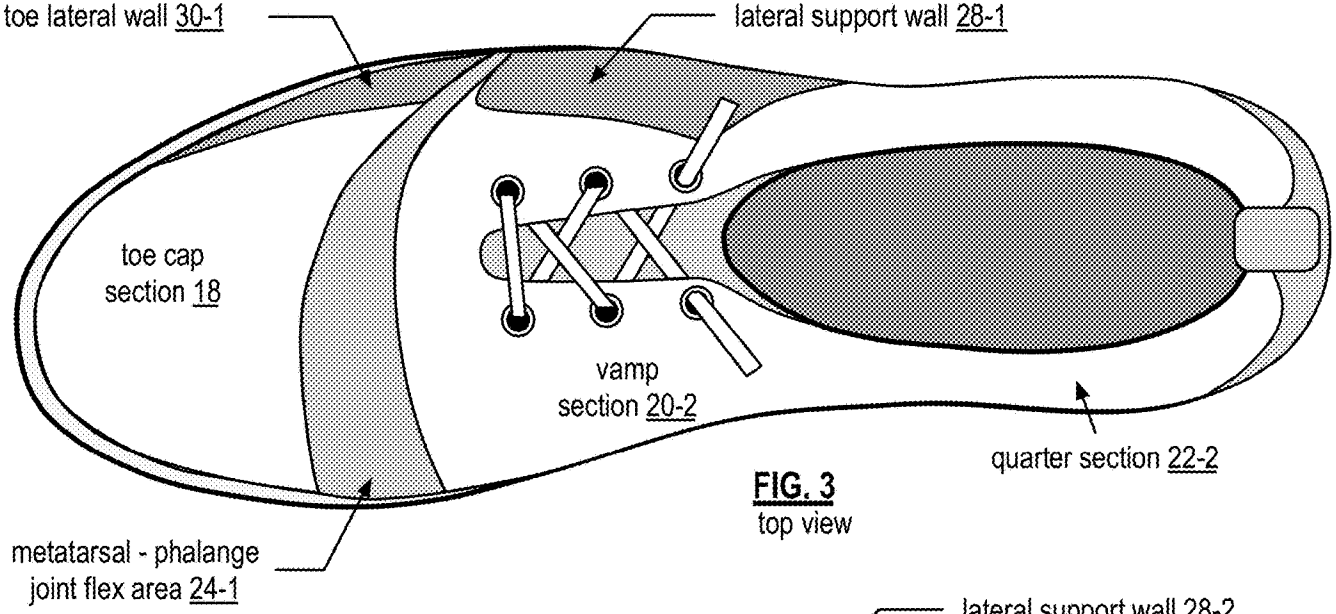
FIG. 3 is a top view diagram of another embodiment of an athletic shoe in accordance with the present invention.

FIG. 3 is a top view diagram of another embodiment of an athletic shoe 10 having a differently shaped metatarsal-phalange joint flex area 24-1, a different vamp section 20-2, and a different quarter section 22-2. In this embodiment, the metatarsal-phalange joint flex area 24-1 has a shape that, from the top view of the upper section, has a substantially partial arch shape of a narrowing width from the medial side of the shoe to the lateral side of the shoe. The metatarsal-phalange joint flex area 24 spans from the medial side of the shoe to the lateral side of the shoe. In contrast, the metatarsal-phalange joint flex area 24 of FIGS. 1 and 2 have a shape that, from a top view of the upper section, has a substantially partial arch shape of a substantially uniform width that spans from a medial side of the shoe to a lateral side of the shoe.

Figure 4:
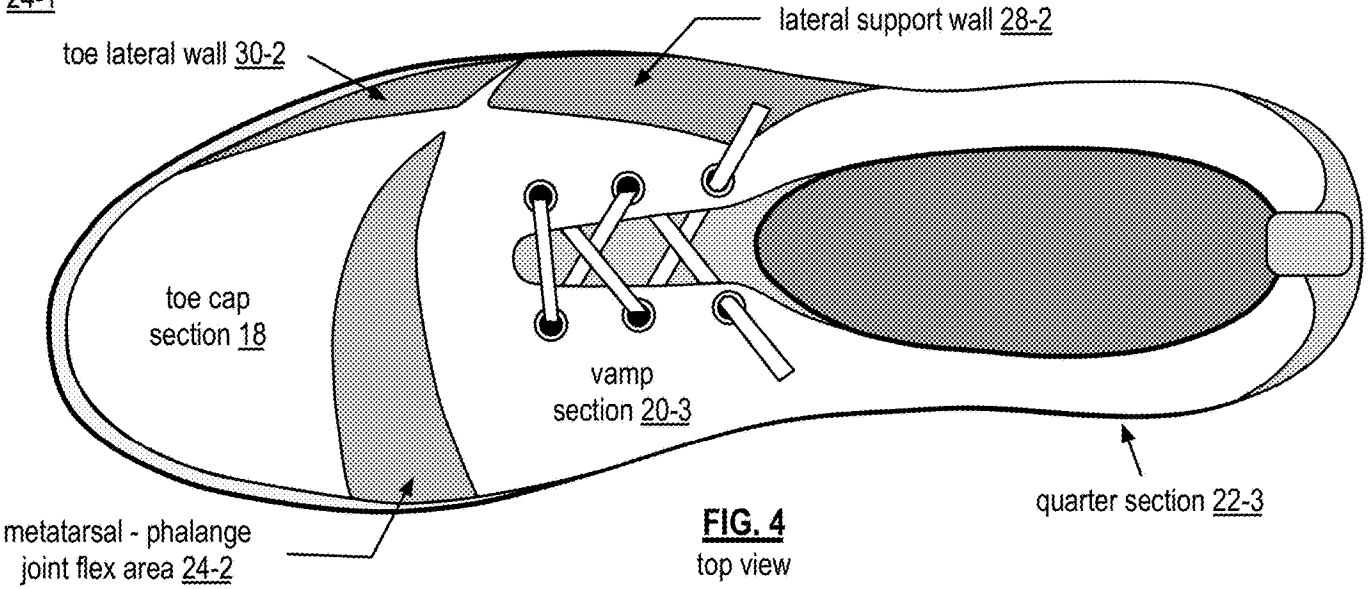
FIG. 4 is a top view diagram of another embodiment of an athletic shoe in accordance with the present invention.

FIG. 4 is a top view diagram of another embodiment of an athletic shoe having another differently shaped metatarsal-phalange joint flex area 24-2, a different vamp section 20-3, and a different quarter section 22-3. In this embodiment, the metatarsal-phalange joint flex area 24-2 has a shape that, from the top view of the upper section, has a substantially partial arch shape of a narrowing width from the medial side of the shoe to the lateral side of the shoe and that spans between half and three-quarters of a distance from the medial side of the shoe to the lateral side of the shoe.

Figure 5:
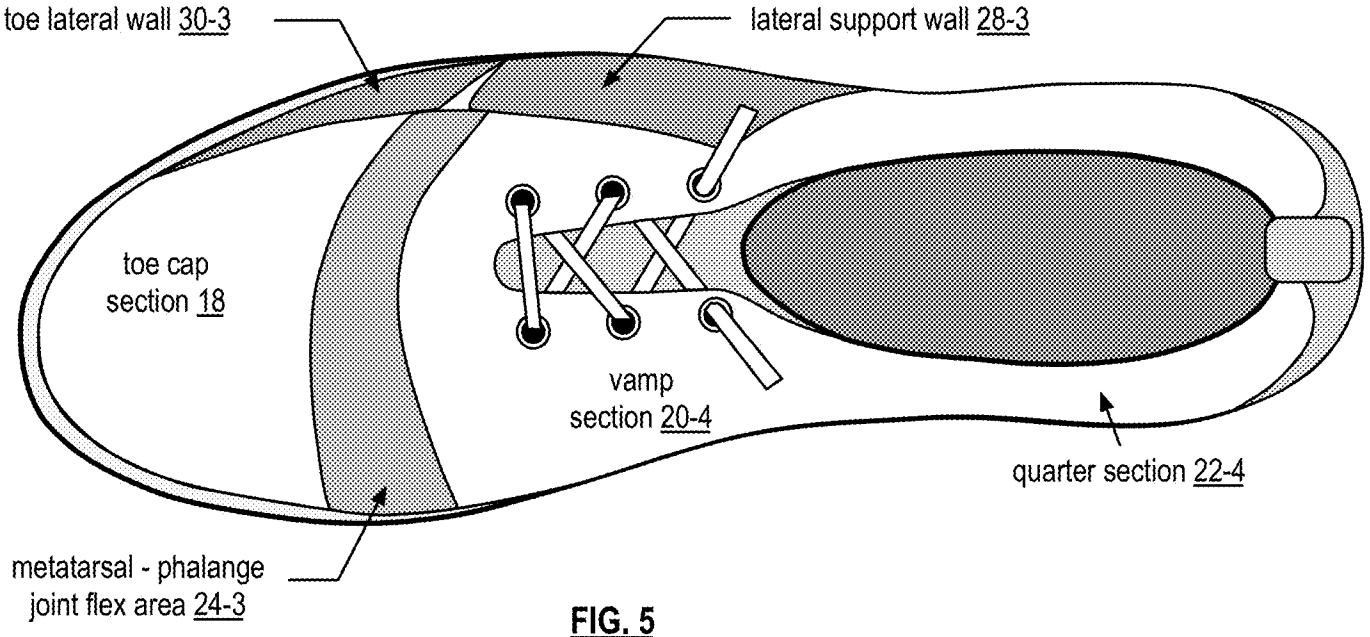
FIG. 5 is a top view diagram of another embodiment of an athletic shoe in accordance with the present invention.

FIG. 5 is a top view diagram of another embodiment of an athletic shoe having yet another differently shaped metatarsal-phalange joint flex area 24-3, a different vamp section 20-4, and a different quarter section 22-4. In this embodiment, the metatarsal-phalange joint flex area 24 has a shape that, from the top view of the upper section, has a substantially partial arch shape of a slightly narrowing width from the medial side of the shoe to the lateral side of the shoe and that spans between half and three-quarters of a distance from the medial side of the shoe to the lateral side of the shoe.

FIGS. 6A-6D are top, medial, lateral, and rear view diagrams, respectively, of an embodiment of an athletic shoe 10 that includes a midsole 12, an outsole 14, an upper section 16, and a sock liner 26-2. The upper section 16 includes a toe cap section 18, a vamp section 20-5, a quarter section 22-5, a metatarsal-phalange joint flex area 24, a sock liner 26, and a securing mechanism 36-1. The upper section 16 may further include a toe lateral wall 30, a lateral support wall 28, and/or a reinforced toe guard 34.

The vamp section 20-5 and the quarter section 22-5 have a different pattern than the shoe of FIG. 1A. In particular, it has the securing mechanism 36-1 (e.g., laces and eyelets) on the medial side. The vamp section 20-5 and the quarter section 22-5 are attached (e.g., stitched, glued, integrated via fabrication, etc.) to the flexible and elastic sock liner 26-2 in one or more places. As an example, the vamp section 20-5 and the quarter section 22-5 are attached at the periphery of the sock liner 26-2. In this manner, the vamp section 20-5 and the quarter section 22-5 are free to move over the sock liner 26-2 and the vamp section 20 is pulled over the top of the foot further accentuating the optimal athletic positioning and fit as the laces are tightened.

The shoe lace based securing mechanism 36-1 may be implemented in a variety of ways. For example, the shoe lace latch is a piece of material similar to the sock liner and sewn to the sock liner along the top and bottom edges of the shoe lace latch to form a slot. When the shoes laces are tied, then are fed through the shoe lace latch 80, which may be a hook a loop, a clasp, or material sewn into the sock liner 26-2.

Figure 7A:
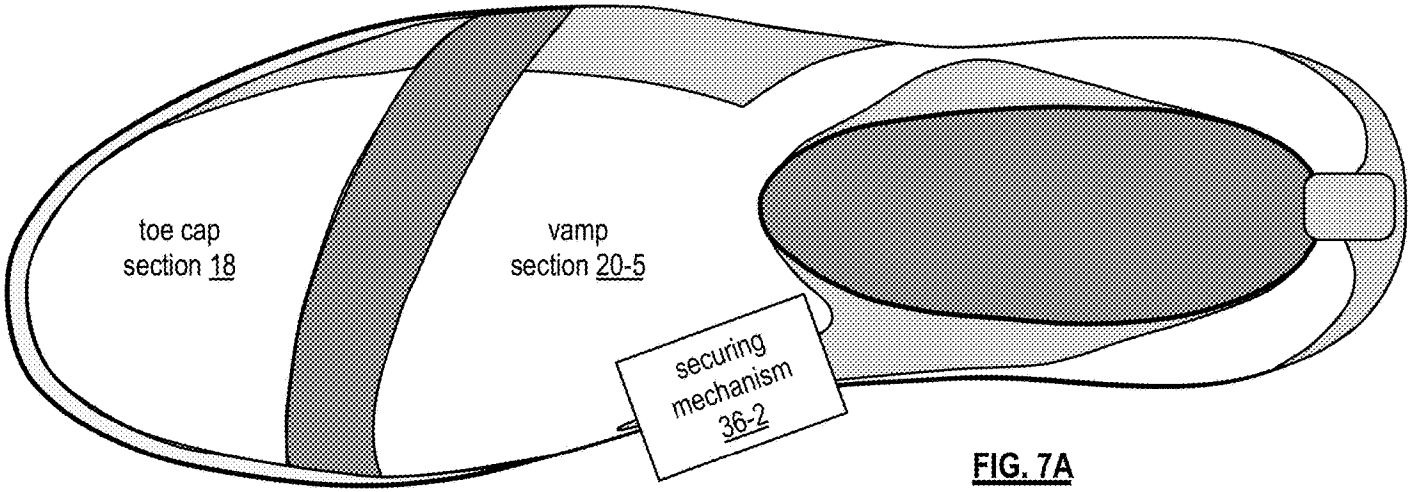
FIG. 7A is a top view diagram of an embodiment of an athletic shoe in accordance with the present invention.
Figure 7B:
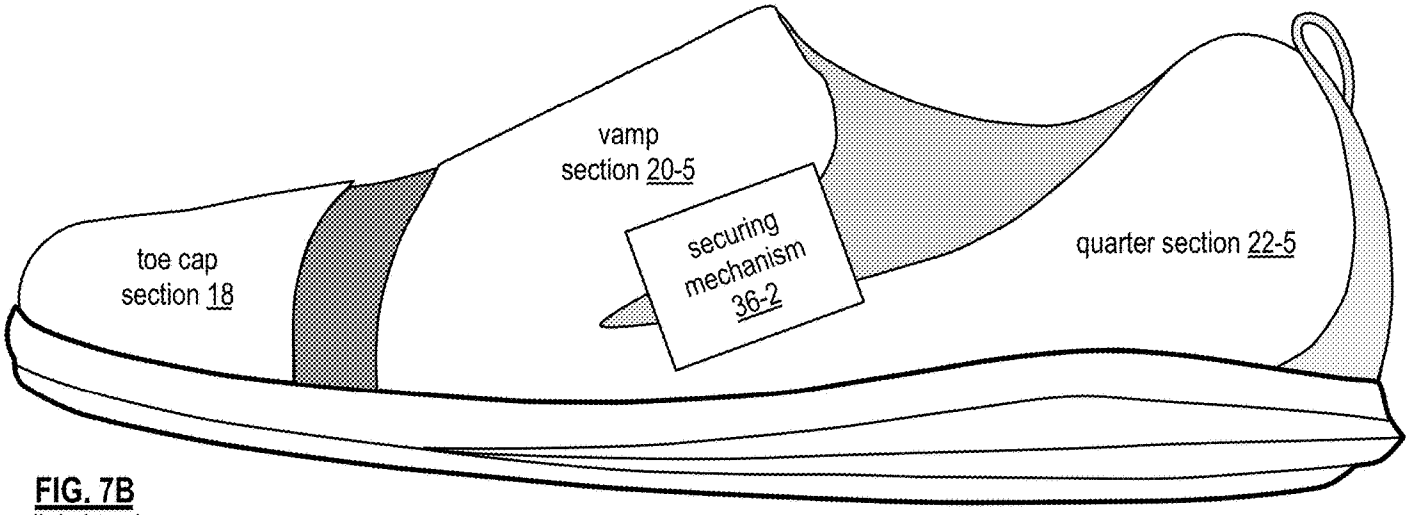
FIG. 7B is a medial view diagram of an embodiment of an athletic shoe in accordance with the present invention.

FIGS. 7A and 7B are top and medial view diagrams of an embodiment of an athletic shoe that is similar to the shoe of FIGS. 6A through 6D, with the exception that the shoe of FIGS. 7A and 7B includes a generic securing mechanism 36-2 instead of laces. The securing mechanism 36-2 may be implemented in a variety of ways. For example, the securing mechanism 36-2 includes one or more strips of Velcro. As another example, the securing mechanism 36-2 includes a ratchet mechanism. As yet another example, the securing mechanism 36-2 includes a level mechanism. As a further example, the securing mechanism 36-2 includes one or more buckles.

Figure 8A:
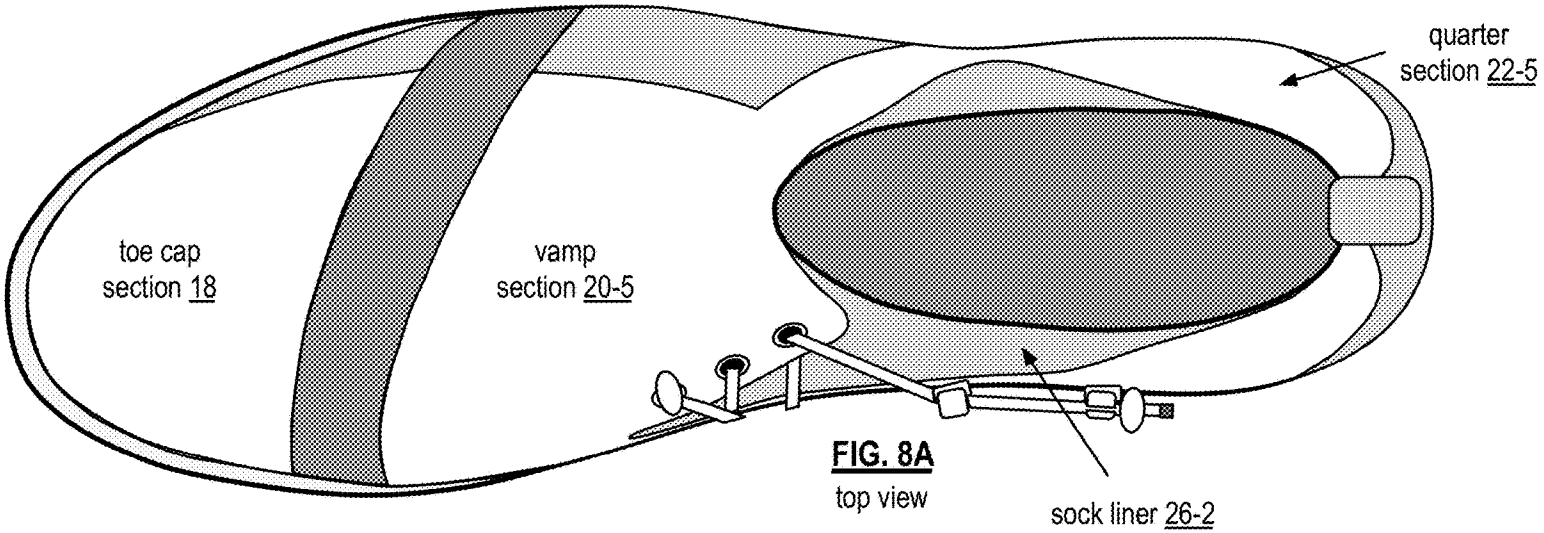
FIG. 8A is a top view diagram of an embodiment of an athletic shoe in accordance with the present invention.
Figure 8B:
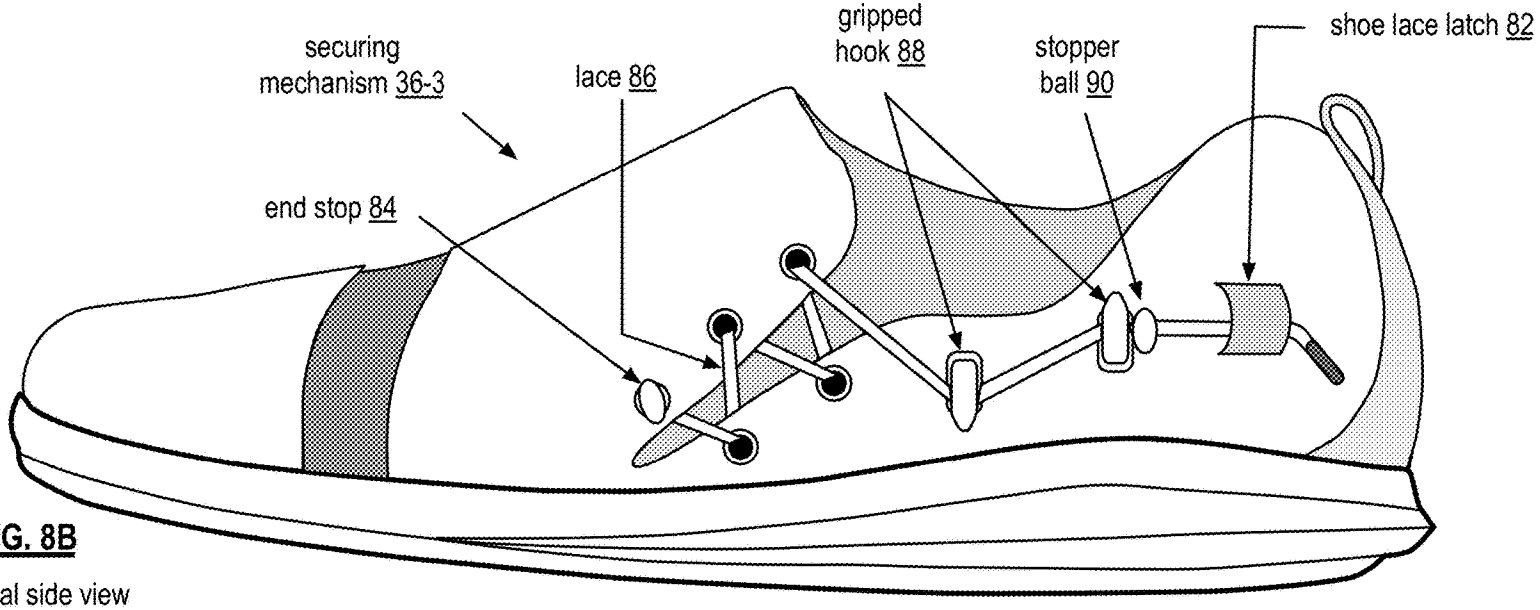
FIG. 8B is a medial view diagram of an embodiment of an athletic shoe in accordance with the present invention.

FIGS. 8A and 8B are top and medial view diagrams of an embodiment of an athletic shoe 10 that is similar to the shoe of FIGS. 6A through 6D, with the exception that the shoe of FIGS. 8A and 8B include a lace 86 with gripped hooks 88 instead of laces. A gripped hook 88 is open on one end for the lace 86 to fit in the opening. The opening includes teeth to hold the lace 86 in the opening once inserted. In this embodiment, to tighten the shoe, the lace 86, which is anchored in the shoe via an end stop 84 (e.g., a ball secured to the end of the lace), is pulled toward the lower medial heel and looped through the first gripped hook 88. The lace 86 is then pulled up and through the second gripped hook 88. The remaining lace is threaded through the shoe lace latch 82, which is piece of material attached to the quarter section 22-5.

When the lace 86 includes one or more stopper balls 90 (e.g., sphere, oval, ellipse, block, etc.), the stopper balls help hold the lace in a tightened position. For example, one stopper ball is placed on the end to secure the lace in one of the eyelets of the upper section. Another stopper ball is positioned toward the end of the lace to provide a stopper for the lace from slipping back through the gripped hooks. In another embodiment, the lace includes multiple stopper balls to allow for different tension settings of the lace.

Figure 9A:
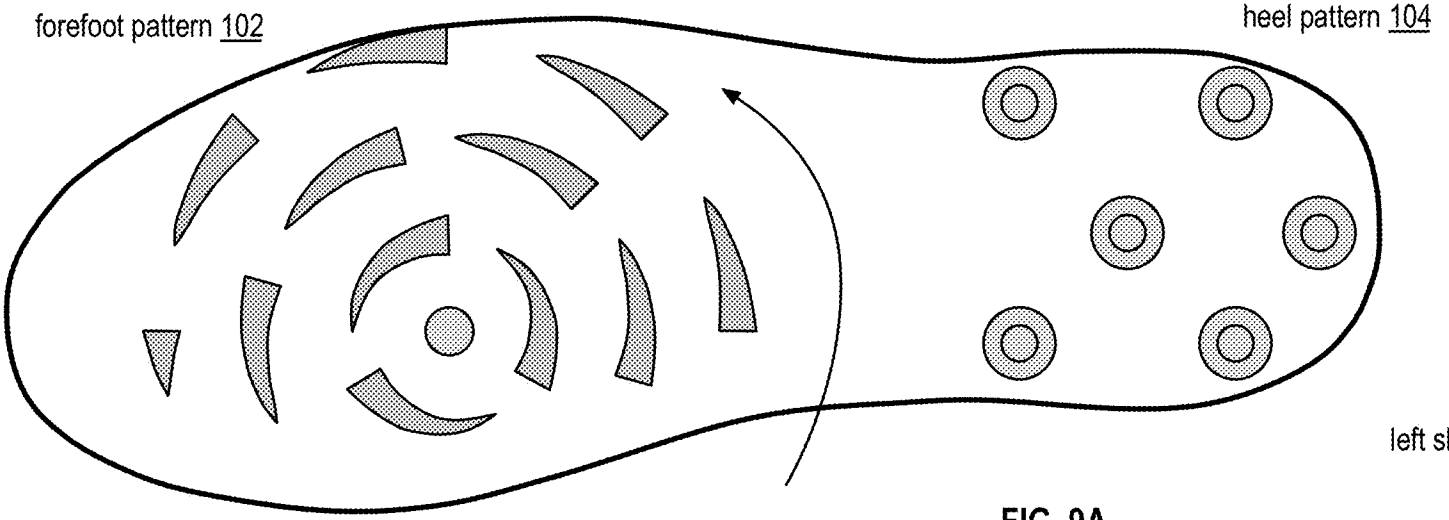
FIG. 9A is a bottom view diagram of an embodiment of a tread pattern for an athletic shoe in accordance with the present invention.

FIG. 9A is a bottom view diagram of an embodiment of a tread pattern for a left foot athletic shoe outsole 100 that includes a forefoot pattern 102 and a heel pattern 104. The heel pattern includes a plurality of cleats (e.g., plastic, rubber, EVA, TPU, metal, etc.) arranged to distribute weight of the heel substantially equally among the cleats. The height of the cleats in the heel section is in the range of a $\frac{1}{8}^{th}$ of an inch to ¾ of an inch. Note that they may be more or less cleats in the heel section than shown.

The forefoot pattern 102 is designed to promote, for the left foot, rotation in one direction (e.g., glide in a clockwise direction with respect to the ground when looking down at the left foot) and to limit foot rotation in the opposite direction (e.g., grip in a counter clockwise direction with respect to the ground when looking down at the left foot). For the right foot, the forefoot pattern 102 promotes rotation in a first direction (e.g., glide in a counter clockwise direction with respect to the ground when looking down at the right foot) and to limit foot rotation in an opposite direction (e.g., grip in a clockwise direction with respect to the ground when looking down at the right foot).

Figure 9B:
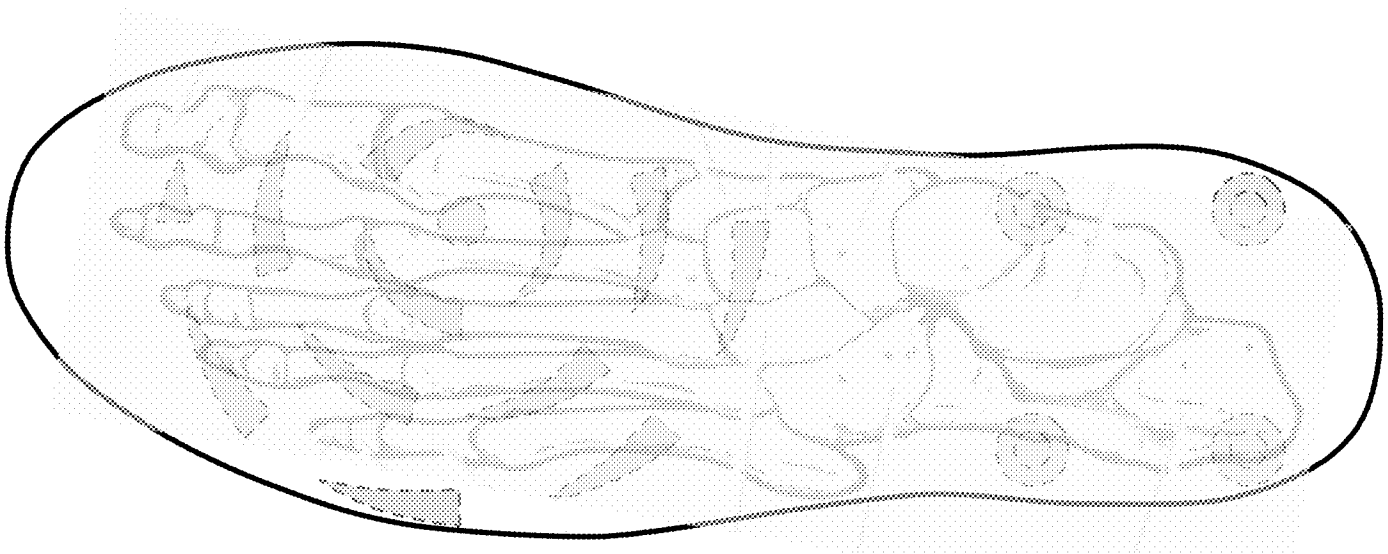
FIG. 9B is a top view diagram of an example of an athletic shoe's tread pattern's positioning with respect to the bones of a foot in accordance with the present invention.

In addition, the forefoot pattern provides a radial ground friction force that provides linear movement traction for a variety of movements (e.g., running forward, running backward, lateral movements, etc.). The center of the rotational pattern 102 includes a cone shaped cleat. As shown in FIG. 9B, the center cleat is position proximal to first and second metatarsal-phalange joints. The forefoot pattern further includes, in increasing sized concentric circles, additional cleats that have a semi-circular raised shape. Examples of the cleats will be further described with reference to FIGS. 11-12C.

Figure 9C:
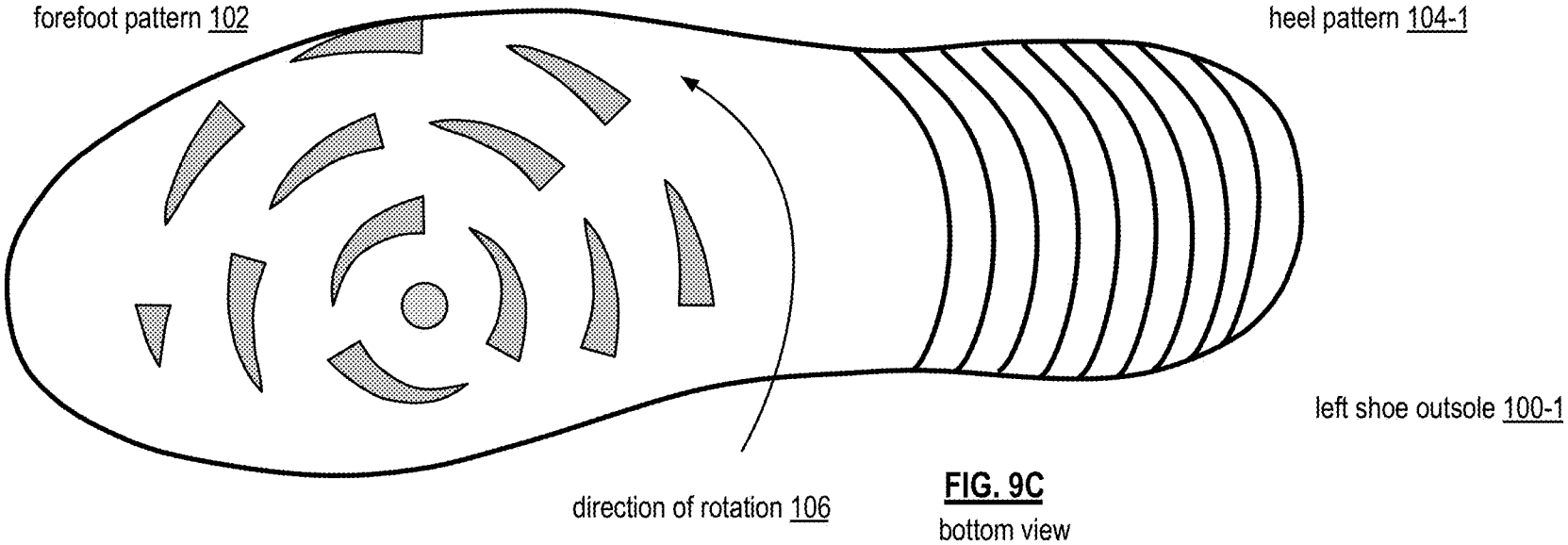
FIG. 9C is a bottom view diagram of an embodiment of a tread pattern for an athletic shoe in accordance with the present invention.

FIG. 9C is a bottom view diagram of another embodiment of a tread pattern for a left foot athletic shoe outsole 100 that includes a forefoot pattern 102 and a heel pattern 104-1. The heel pattern 104-1 includes a plurality of partially arched saw tooth shaped cleats that span from the medial edge to the lateral edge. The height of the saw tooth shaped cleats is in the range of a $\frac{1}{8}^{th}$ of an inch to $\frac{3}{8}^{th}$ of an inch. Note that they may be more or less cleats in the heel section than shown.

Figure 9D:
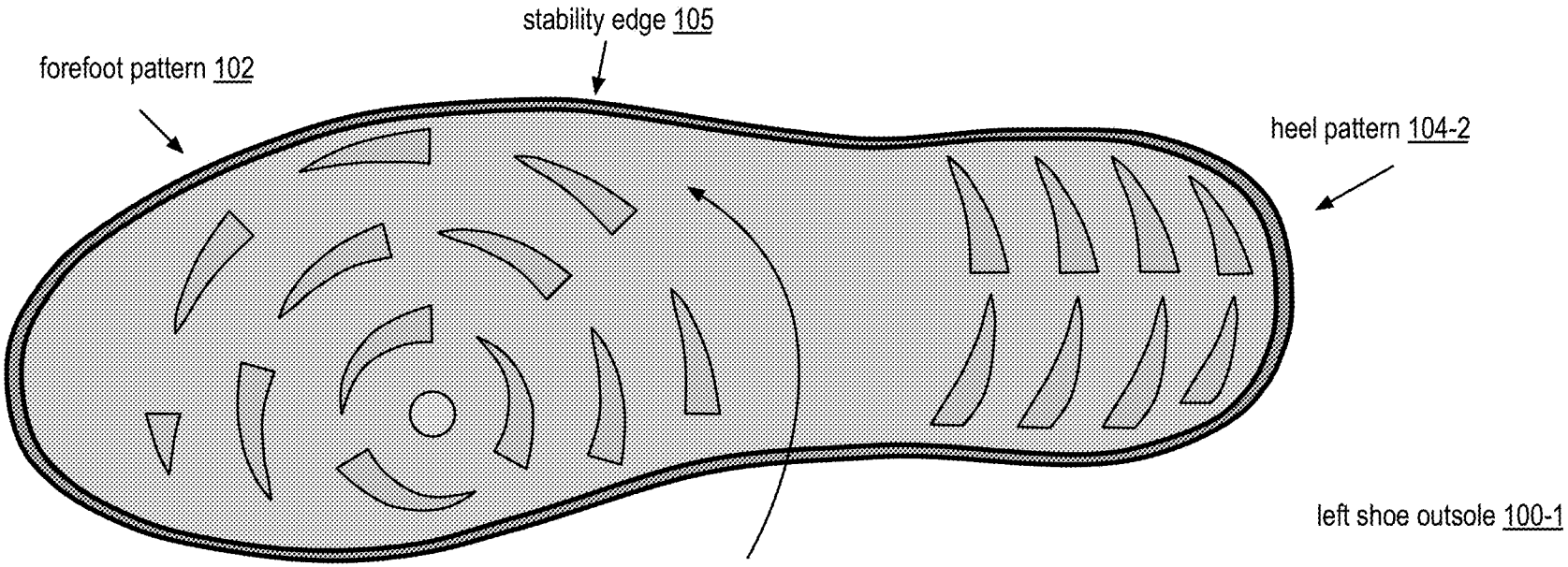
FIG. 9D is a bottom view diagram of another embodiment of a tread pattern for an athletic shoe in accordance with the present invention.

FIG. 9D is a bottom view diagram of another embodiment of a tread pattern for a left foot athletic shoe outsole 100 that includes a forefoot pattern 102, a heel pattern 104-2, and a stability edge 105. The heel pattern 104-2 includes a plurality of cleats that have similar shape to the cleats on the forefoot section 102 and that span from the medial edge to the lateral edge. The height of the cleats is in the range of a $\frac{1}{8}^{th}$ of an inch to $\frac{3}{8}^{th}$ of an inch. Note that they may be more or less cleats in the heel section than shown.

The stability edge 105 is shown to encircle the outsole and includes a plurality of smaller cleats that have a similar height to, or are shorter than, the cleats of the forefoot section and/or in the heel section 104-02. The cleats in the stability edge 105 may have a variety of shapes and the cleats may all be of the same shape and/or of different shapes. For example, the cleats of the stability edge have a diamond shape, a star shape, a rectangular shape, a square shape, a polygonal shape, and/or a combination thereof. The stability edge 105 cleats function to provide additional contact points between the outsole and the ground to further enhance a ground-body interaction.

Figure 10:
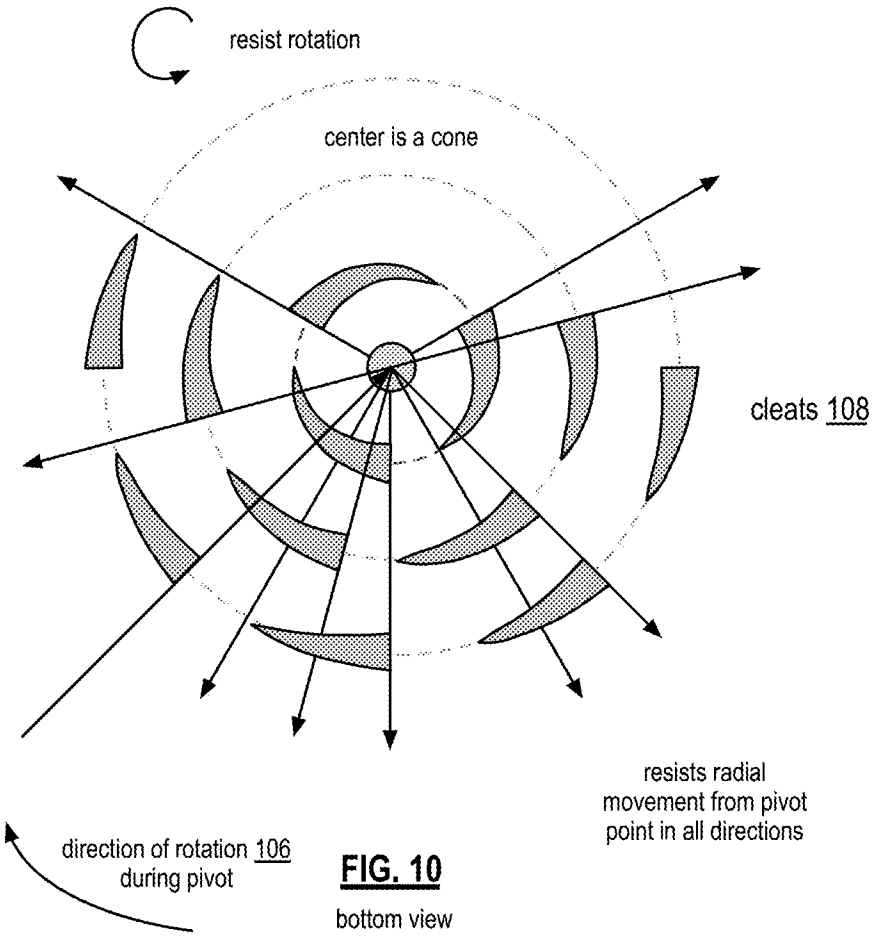
FIG. 10 is a diagram of an example of a tread pattern for a forefoot an athletic shoe in accordance with the present invention.

FIG. 10 is a diagram of an example of a tread pattern for a forefoot an athletic shoe of a right shoe that includes a plurality of cleats 108. The tread pattern promotes, for the right foot when looking at the outsole, clockwise rotation and resists counterclockwise rotation with respect to ground. The tread pattern also promotes, for the left foot when looking at the outsole, counter clockwise rotation and resists clockwise rotation with respect to ground. As such, the tread pattern has a first ground friction force that promotes rotation and a second ground friction force that restricts rotation, where the second ground friction force is greater than the first ground friction force.

The tread pattern further resists radial movement from the center point (e.g., provides traction for linear movements) by providing a radial ground friction force. The size of the cleats may be the same or of different sizes. For example, the cleats closer to the cone cleat in the middle of pattern may be smaller than cleats further away from the center. The arc segment of cleats will be different from ring to ring. For cleats on the same ring, the length of the arc segment may be the same or different.

Figure 11:
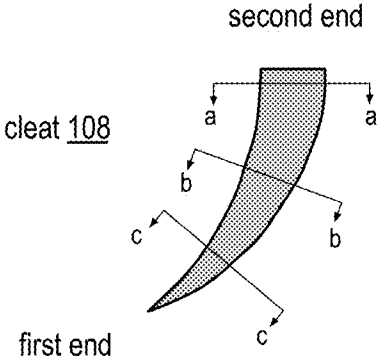
FIG. 11 is a diagram of an embodiment of a cleat in a tread pattern for an athletic shoe in accordance with the present invention.
Figure 12A:
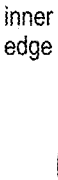
FIGS. 12A-12C are cross sectional diagrams of the cleat of FIG. 11.
Figure 12B:
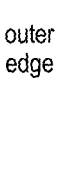
Figure 12C:
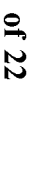

FIG. 11 is a diagram of an embodiment of a cleat 108 in a forefoot tread pattern for an athletic shoe that includes an arch segment shape. FIGS. 12A-12C illustrate cross sectional views of the cleat of FIG. 11. The cleat has a first end and a second end. The first end has a first height and a first width and the second end has a surface that has a second height and a second width. The second height is greater than the first height and the second width is greater than the first width. The first end is a distance from the second end and the surface of the second end is at an angle (e.g., 30° to 150°) with respect to the outer surface of the outsole.

As shown in FIGS. 12A-12C, the succession of cross sections illustrates that, in the direction of rotation 106, the cleat gets narrower and shorter. In particular, the cleat is taller and thicker in cross section a-a than in cross section b-b, which, in turn, is taller and thicker than cross section c-c.

Figure 12D:
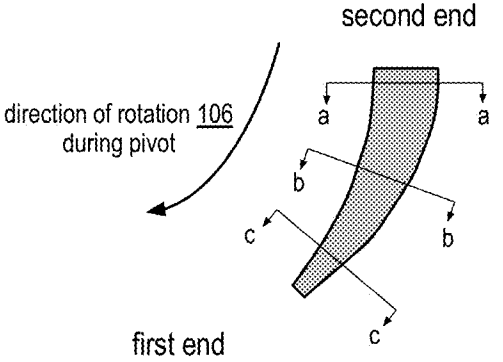
FIG. 12D is a diagram of another embodiment of a cleat in a tread pattern for an athletic shoe in accordance with the present invention.

FIG. 12D is a diagram of another embodiment of a cleat 108-1 in a forefoot tread pattern for an athletic shoe that includes an arch segment shape. FIGS. 12D-12G illustrate cross sectional views of the cleat of FIG. 12D. The cleat has a first end and a second end. The first end has a first height and a first width and the second end has a surface that has a second height and a second width. The second height is greater than the first height and the second width is greater than the first width. The first end is a distance from the second end and the surface of the second end is at an angle (e.g., 30° to 150°) with respect to the outer surface of the outsole.

Figures 12E, 12F, 12G:
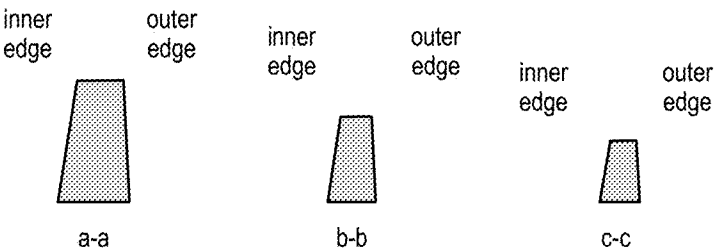
FIGS. 12E-12G are cross sectional diagrams of the cleat of FIG. 12D.

As shown in FIGS. 12E-12G, the succession of cross sections illustrates that, in the direction of rotation 106, the cleat gets narrower and shorter, thus providing less ground friction force that in the opposite direction of rotation. In particular, the cleat is taller and thicker in cross section a-a than in cross section b-b, which, in turn, is taller and thicker than cross section c-c.

Figure 12H:
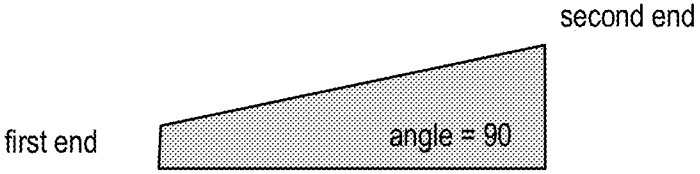
FIGS. 12H-12J are side view diagrams of the cleat of FIG. 11 and/or of FIG. 12D.
Figure 12I:
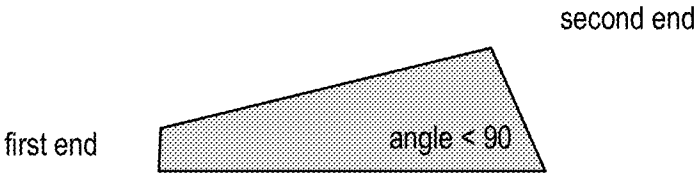
Figure 12J:
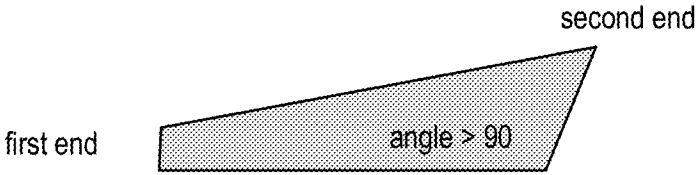

FIGS. 12H-12I are side view diagrams of the cleat of FIG. 11 and/or of FIG. 12D. FIG. 12H illustrates the angle for the surface of the second end to be at approximately 90 degrees. FIG. 12I illustrates the angle for the surface of the second end to be less than 90 degrees. FIG. 12J illustrates the angle for the surface of the second end to be greater than 90 degrees. By varying the angle of the second surface, the second ground friction force is adjustable. For instance, the second ground friction force is increased with respect to the 90 degree angle when the angle is greater than 90 degrees and the second ground friction force is decreased with respect to the 90 degree angle when the angle is less than 90 degrees.

Figures 13A, 13B:
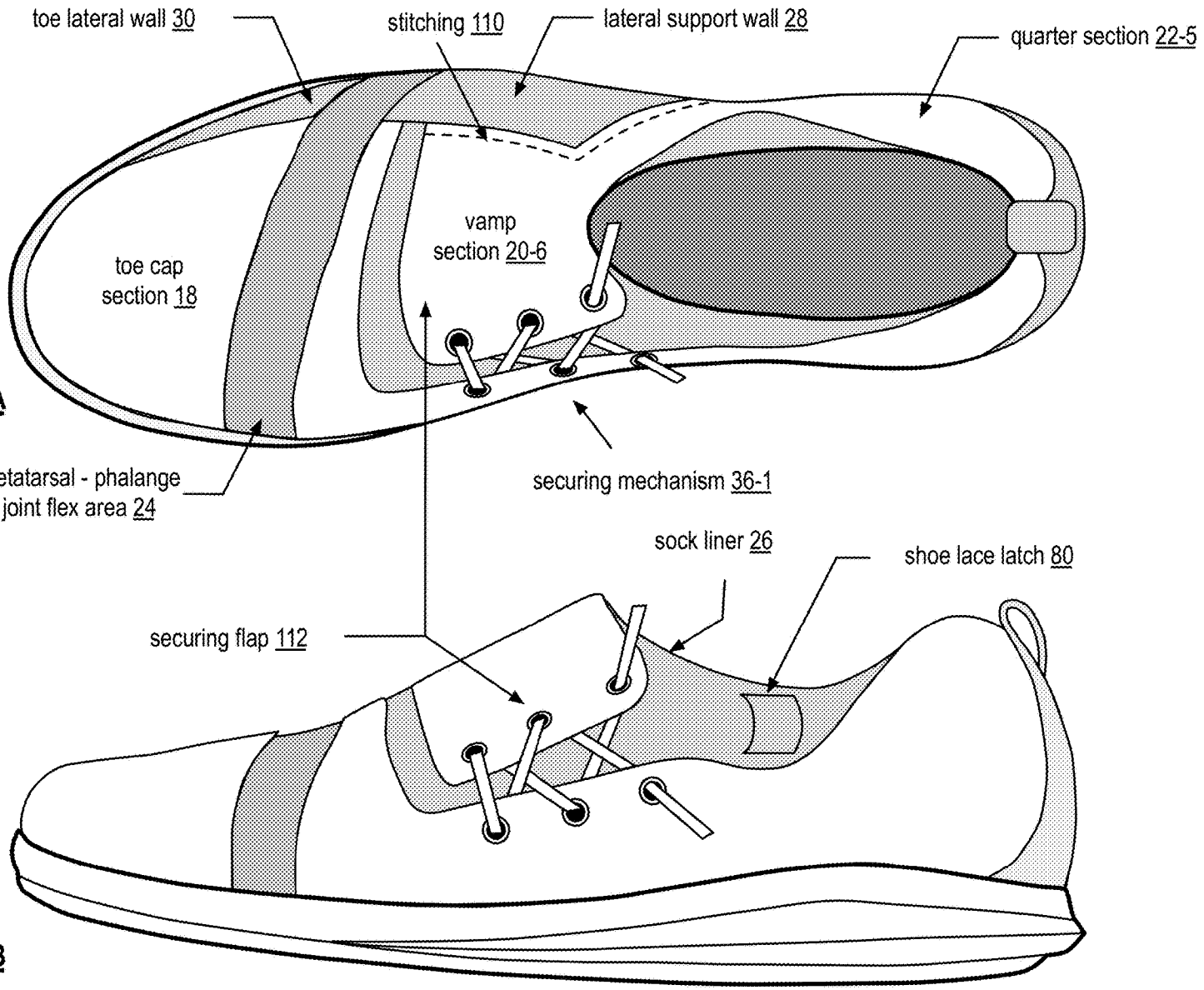
FIG. 13A is a top view diagram of an embodiment of an athletic shoe in accordance with the present invention.
FIG. 13B is a medial view diagram of an embodiment of an athletic shoe in accordance with the present invention.

FIGS. 13A and 13B are top and medial view diagrams of an embodiment of an athletic shoe that is similar to the shoe of FIGS. 6A through 6D, with the exception that the shoe of FIGS. 13A and 13B includes a different vamp section 20-6. In this embodiment, the vamp section 20-6 includes a slot to provide a securing flap 112. The securing flap 112 is stitched 110 along the lateral support wall 28 and resides on top of the sock liner 26. In this manner, the securing flap 112 can be pulled over the top of the foot to further support the optimal athletic positioning.

Figures 14A, 14B:
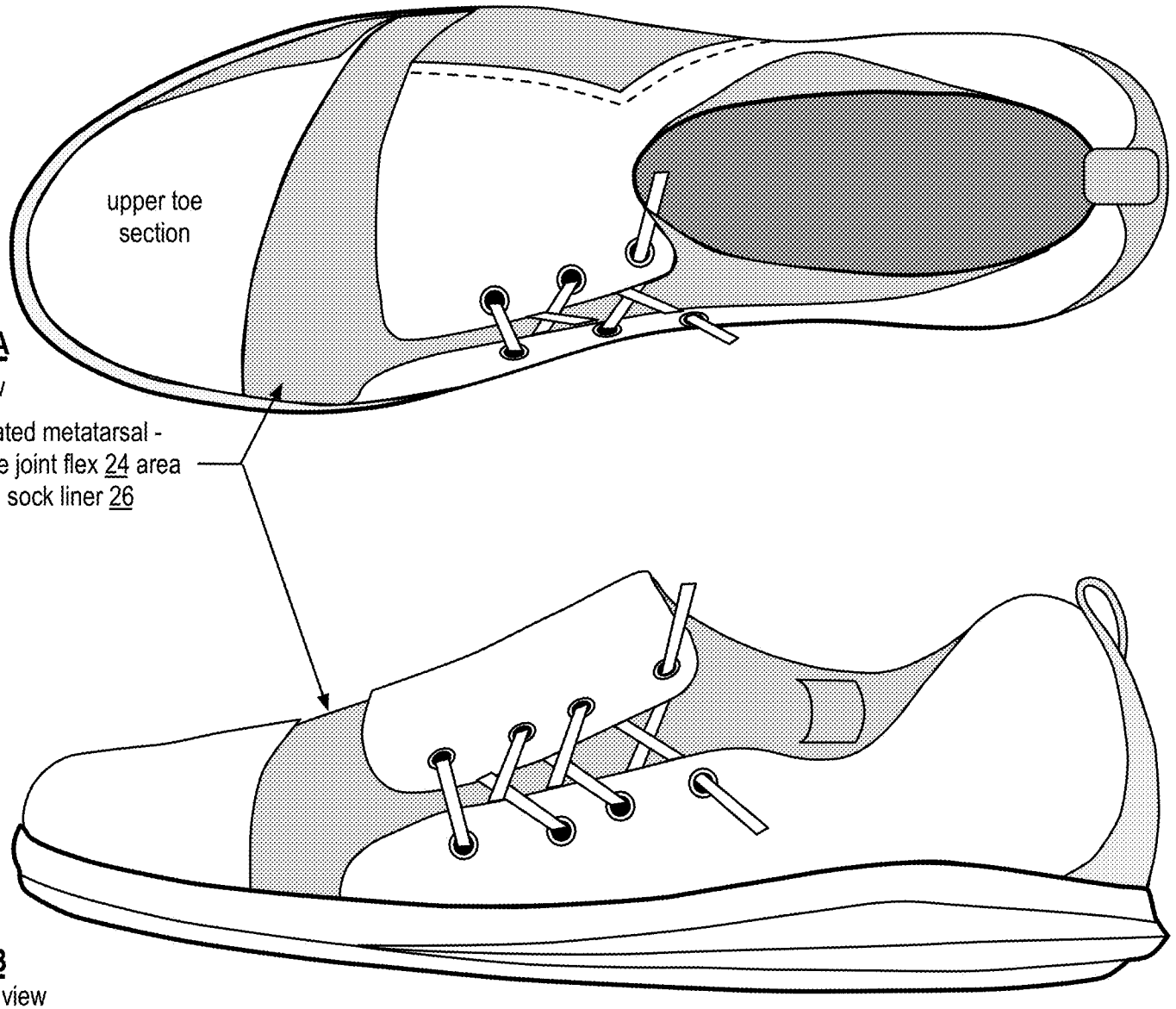
FIG. 14A is a top view diagram of an embodiment of an athletic shoe in accordance with the present invention.
FIG. 14B is a medial view diagram of an embodiment of an athletic shoe in accordance with the present invention.

FIGS. 14A and 14B are top and medial view diagrams of an embodiment of an athletic shoe that is similar to the shoe of FIGS. 13A through 13B, with the exception that the shoe of FIGS. 14A and 14B includes an integrated metatarsal-phalange joint flex area 24 and sock liner 26, which may be constructed from the materials used to create the flex area 24 in previously discussed embodiments and/or from the materials used to create the sock liner 26.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "configured to", "operably coupled to", "coupled to", and/or "coupling" includes direct coupling between items and/or indirect coupling between items via an intervening item (e.g., an item includes, but is not limited to, a component, an element, a circuit, and/or a module) where, for an example of indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "configured to", "operable to", "coupled to", or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item.

As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1. As may be used herein, the term "compares unfavorably", indicates that a comparison between two or more items, signals, etc., fails to provide the desired relationship.

The one or more embodiments are used herein to illustrate one or more aspects, one or more features, one or more concepts, and/or one or more examples. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

While particular combinations of various functions and features of the one or more embodiments have been expressly described herein, other combinations of these features and functions are likewise possible. The present disclosure is not limited by the particular examples disclosed herein and expressly incorporates these other combinations

What is claimed is:

1. An athletic shoe comprises:

an upper section;

a midsole coupled to the upper section; and an outsole coupled to the midsole, wherein the outsole includes an outer surface, wherein a forefoot section of the outer surface includes a plurality of angled cleats that at least partially encircle a rotation point of the forefoot section, wherein an angled cleat of the plurality of angled cleats includes a first end and a second end, wherein the first end has a smaller surface area than the second end.

2. The athletic shoe of claim 1, wherein the angled cleat further comprises:

a linear outer edge to provide a ground friction force that restricts radial movement in a linear radial direction from the rotation point.

3. The athletic shoe of claim 1 further comprises:

the first end of the angled cleat having a first height and a first width; and the second end of the angled cleat having a surface that has a second height and a second width, wherein:

the first end is a distance from the second end;

the surface of the second end is at an angle to the outer surface of the outsole;

the angle is in the range of thirty degrees to one-hundred fifty degrees;

the second height is greater than the first height; and the second width is greater than the first width.

4. The athletic shoe of claim 3, wherein the angled cleat further comprises:

a first side between the first end and the second end; and a second side between the first end and the second end, wherein:

the first side, from a bottom view perspective of the outsole, has a first radial arch; and the second side, from the bottom view perspective of the outsole, has a second radial arch.

5. The athletic shoe of claim 3, wherein the encircling pattern comprises:

a first group of angled cleats of the plurality of angled cleats distributed in a first pattern about the rotation point; and a second group of angled cleats of the plurality of angled cleats distributed in a second pattern about the rotation point, wherein the second pattern substantially encircles the first pattern.

6. The athletic shoe of claim 5, wherein the encircling pattern comprises:

a third group of angled cleats of the plurality of angled cleats distributed in a third pattern about the rotation point, wherein the third pattern substantially encircles the second pattern.

7. The athletic shoe of claim 5 further comprises:

a first angled cleat of the first group of angled cleats has a first distance between the first and second ends of the first angled cleat; and a second angled cleat of the second group of angled cleats has a second distance between the first and second ends of the second angled cleat, wherein the second distance is greater than the first distance.

8. The athletic shoe of claim 1, wherein the angled cleat further comprises one of:

a linear inner edge; and a sloped inner edge.

9. The athletic shoe of claim 1, wherein the forefoot section further comprises:

a conical cleat positioned at approximately the rotation point.

10. The athletic shoe of claim 1, wherein the angled cleat comprises:

a material composition that is substantially equivalent to the material composition of the outsole.

11. The outsole of claim 1, wherein the angled cleat comprises:

a metal composition and is attached to the outsole.

* * * * *